US006085650A

United States Patent [19]

Petersen

[11] Patent Number: 6,085,650

[45] Date of Patent: Jul. 11, 2000

[54] PRINTING UNIT FOR A WEB-FED ROTARY PRINTING MACHINE

[75] Inventor: Godber Petersen, Augsburg, Germany

[73] Assignee: MAN Roland Druckmaschinen AG, Offenbach am Main, Germany

[21] Appl. No.: 09/250,195

[22] Filed: Feb. 16, 1999

[30] Foreign Application Priority Data

Feb. 13, 1998 [DE] Germany ..... 198 05 898

[51] Int. Cl.[7] ..... B41F 5/00

[52] U.S. Cl. ..... 101/220; 101/247; 101/477; 101/478; 101/479; 101/480; 101/481

[58] Field of Search ..... 101/220, 216, 101/219, 229, 477, 478, 479, 480, 481, 153, 141, 138, 181

[56] References Cited

U.S. PATENT DOCUMENTS

| | | | |
|---|---|---|---|
| 3,424,084 | 1/1969 | Chambon | 101/219 |
| 5,109,768 | 5/1992 | Lübke et al. | 101/153 |
| 5,394,797 | 3/1995 | Döbler et al. | 101/216 |
| 5,471,929 | 12/1995 | Rogge et al. | 101/247 |
| 5,485,782 | 1/1996 | Van Der Horst | 101/247 |
| 5,528,986 | 6/1996 | Anderson et al. | 101/479 |
| 5,699,735 | 12/1997 | Stein et al. | 101/220 |
| 5,806,427 | 9/1998 | Niemiro et al. | 101/477 |

FOREIGN PATENT DOCUMENTS

| | | |
|---|---|---|
| 195 34 51 | of 0000 | Germany . |
| 196 24 393 | of 0000 | Germany . |
| 196 24 394 | of 0000 | Germany . |
| 196 24 441 | 12/1997 | Germany . |
| 196 50 812 | 6/1998 | Germany . |
| 2-24936 | 2/1990 | Japan . |
| 2-86445 | 3/1990 | Japan . |
| 6-98743 | 10/1991 | Japan . |
| 5-9171 | 3/1993 | Japan . |
| 6-226948 | 8/1994 | Japan . |
| 9-183208 | 7/1997 | Japan . |
| 9-207307 | 8/1997 | Japan . |

*Primary Examiner*—Eugene Eickholt
*Attorney, Agent, or Firm*—Cohen, Pontani, Lieberman & Pavane

[57] ABSTRACT

A printing unit enabling format variability, is distinguished by substantial component standardization and simple stand design. For this purpose, printing unit cylinders are mounted in slides which are arranged on at least one carrier and which, for distance adjustment, can be displaced on the carrier in each case by means of a drive.

31 Claims, 26 Drawing Sheets

PRINTING UNIT FOR A WEB-FED ROTARY PRINTING MACHINE

BACKGROUND OF THE INVENTION

1. Field of the Invention

The invention relates to a printing units and more particularly to a printing unit for a web-fed rotary printing machine.

2. Description of the Related Art

German Application No. DE 195 34 651.3 shows a printing unit for indirect printing, in which the distance between the transfer and form cylinders is adjustable. This enables printing to be carried out with cylinders of variable circumference (i.e., different diameters). The diameter of the transfer and form cylinders is varied by equipping the same with sleeves having different diameters. For distance adjustment, carrier plates are guided on the side walls. The printing unit cylinders are mounted directly or indirectly in said carrier plates. A stable wall design is necessary for this purpose. Adjustment is carried out by means of working cylinders or spindle mechanisms.

SUMMARY OF THE INVENTION

It is an object of the invention to provide a printing unit having substantially standardized components and a simple stand design while preserving format variability.

This and other objects are achieved in a generic printing unit according to the invention. According to an embodiment of the present invention, the printing unit cylinders are received on the carriers, thus eliminating the need, with the exception of a satellite version, for printing unit side walls. This affords the possibility of a lighter form of construction for printing units. Advantageously, the slide mounting on the carriers makes it possible to adjust the distance between the printing unit cylinders when variations in their diameters are being performed. In addition, different cylinder positionings for setting up different printing unit configurations and for printing units having different printing methods are also possible in a simple way. In all these situations, a multiplicity of components that are unchanged are employed. The result is that the printing unit can be cost-effectively mass-produced in large quantities. Likewise, subassemblies for the production of printing forms in the printing unit can easily be approached by the form cylinders and subassemblies, for example inking units, can easily be placed on the slide. There is no need to provide side wall orifices in order to change sleeves which are located on the printing unit cylinders.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
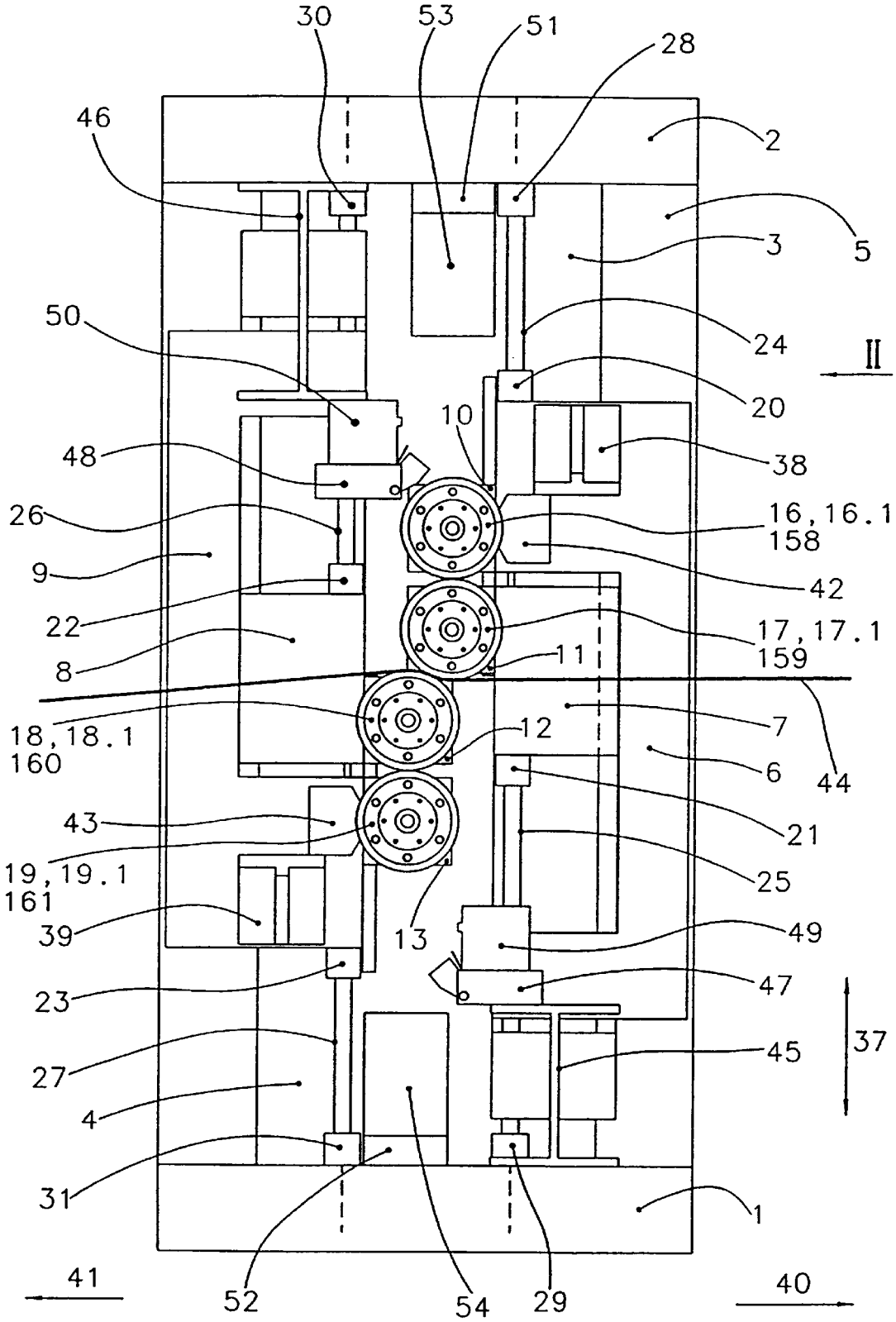
FIG. 1 is a side view of a double printing unit for indirect intaglio printing, with overhung printing unit cylinders according to an embodiment of the present invention.

FIGS. 1 to 5 show a double printing unit for a web-fed rotary printing machine, in which unit two vertically arranged carriers 3 and 4 are closed off at their ends by means of end plates 2 and 1, respectively. Two slides 6, 7 and 8, 9 are displaceably mounted on each respective carrier 3 and 4. Four printing unit cylinders 16 to 19 are mounted in the slides 6 to 9. Specifically form cylinders 16 and 19 are mounted in slides 6 and 9, respectively, and transfer cylinders 17 and 18 are mounted in slides 7 and 8, respectively. A motor spindle 10, 11, 12 and 13 (FIG. 4) are attached to the respective cylinder bodies 16.1, 17.1, 18.1 and 19.1 by screws. A spindle and an electric motor driving the latter are accommodated in each case in the tubular housing of the motor spindles 10 to 13. Motor spindles of this type are described in DE 196 24 394 C1. There is no need for the eccentric spindle arrangement also shown there, since, in the present solution, the printing unit cylinders 16–19 are adjusted by means of the displacement of the slides 6–9. The printing unit cylinders 16–19 may also be designed and mounted in a different way, for example may carry journals, by means of which they are received in bearings.

The carriers 3 and 4 are of stable design, that is to say they have high bending resistance. They are virtually self-supporting, so that there is no need for printing unit side walls. Only the end plate 1 for erecting the carriers 3 and 4 is necessary. Even the upper end plate 2 may be dispensed with, if printing unit components are not to be fastened there. Depending on the number of printing unit cylinders 16–19 and on the design of the slides 6–9, printing unit variants containing only one carrier 3 or 4 are also possible.

Figure 5:
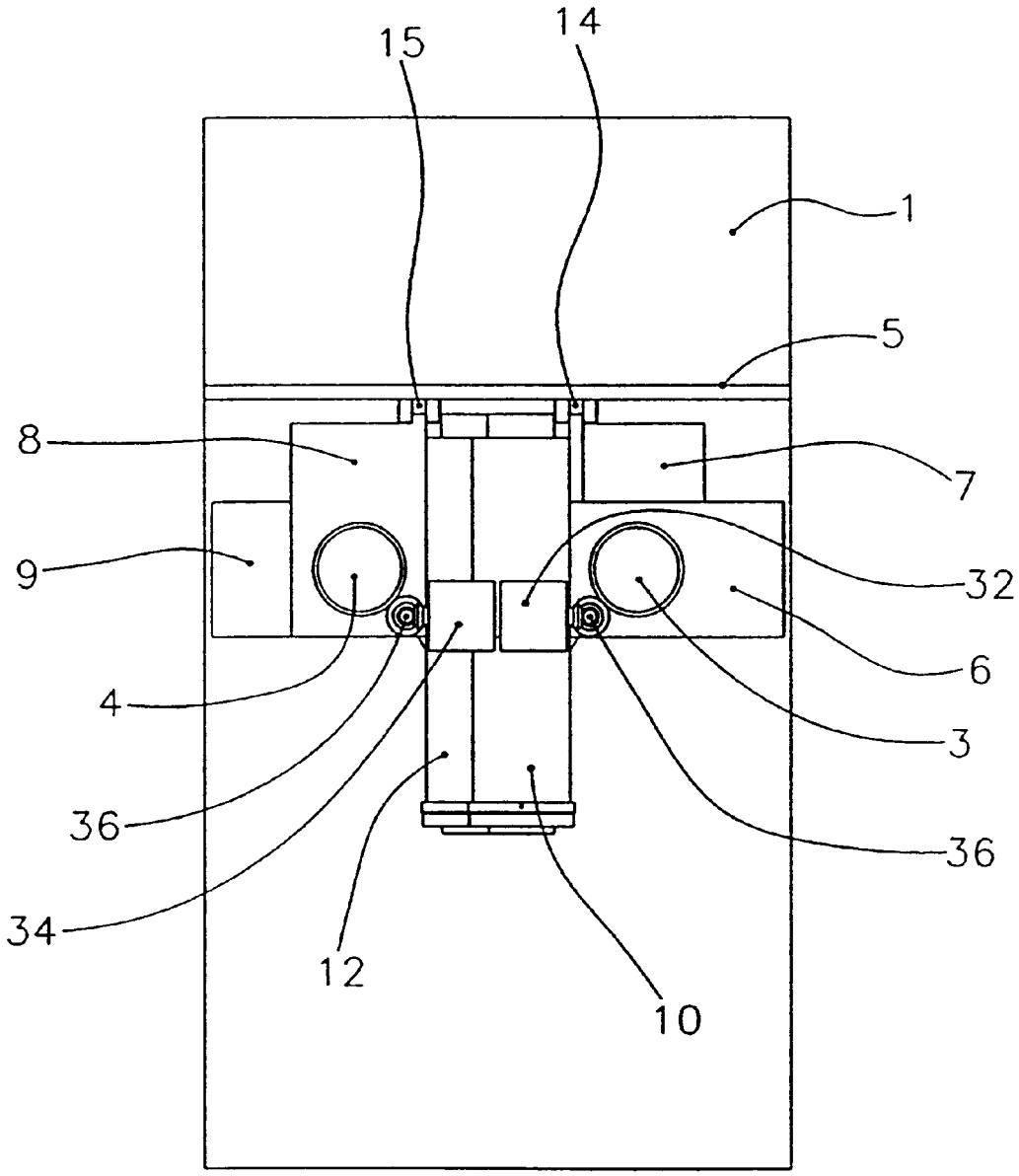
FIG. 5 is a view of the double printing unit taken from the perspective indicated by V in FIG. 4.

For manufacturing reasons, the carriers 3 and 4 advantageously have a circular cross section (FIG. 5). In order to secure the slides 6–9 against rotation, a plate 5 is arranged next to the carriers 3 and 4 and having flat guides 14 and 15, into which the slides 6, 7 and 8, 9 engage, respectively. Devices for eliminating errors in alignment of the cylinders are also provided at this point. Devices of this type are shown in German application No. DE 196 24 393 A1.

Figure 4:
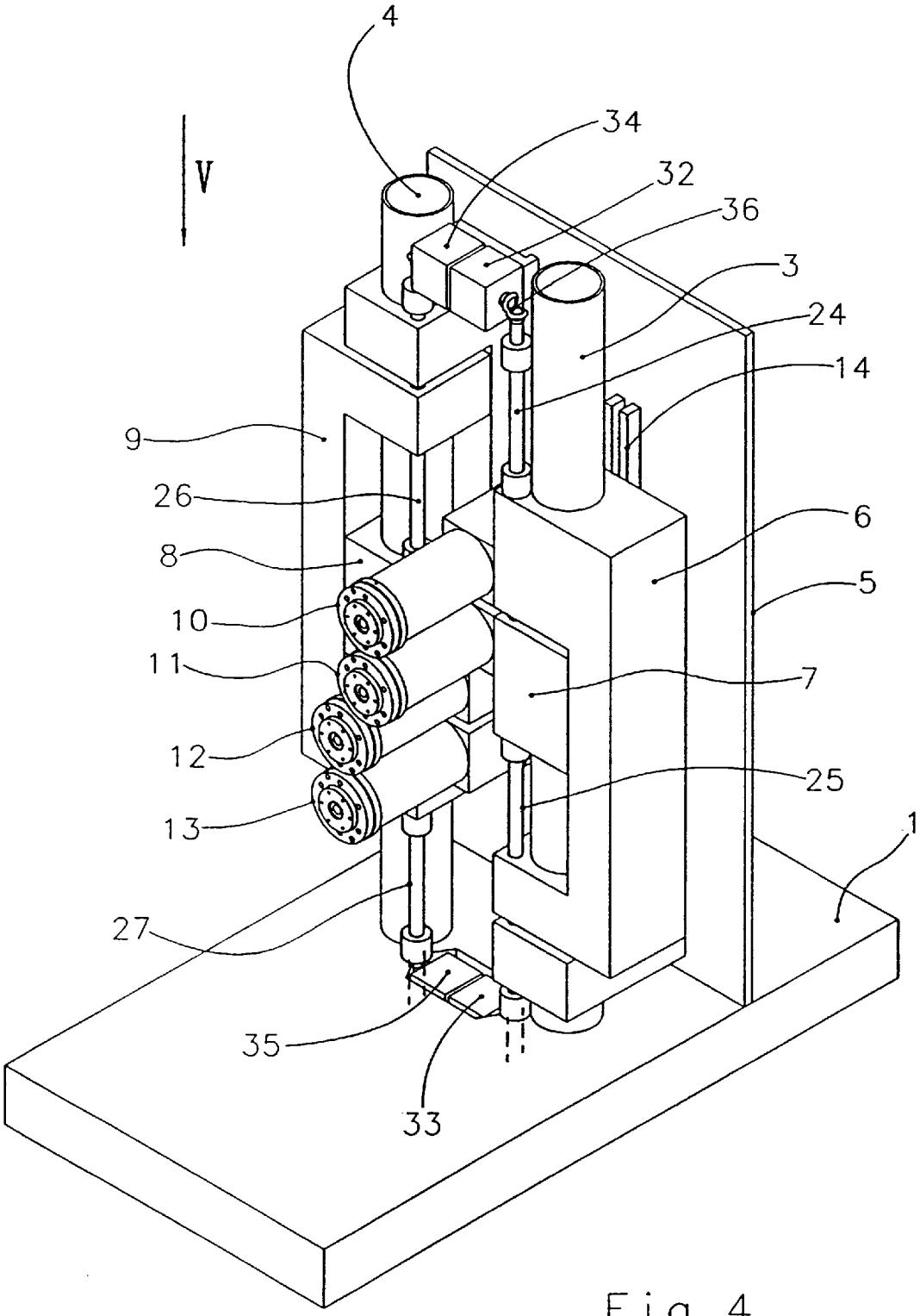
FIG. 4 is a partial view of the double printing unit shown in FIG. 3, with the cylinder bodies, inking units, an end plate and components for printing form production being omitted.

Drives are provided for displacing the slides 6 to 9 on the respective carriers 3 and 4 in the directions 37. In particular, each slide 6, 7, 8 and 9 carries a respective threaded nut 20, 21, 22 and 23, into which a threaded spindle 24, 25, 26 and 27 engages, respectively. The threaded spindles 24, 25, 26 and 27 are supported in each case in an axial bearing 28, 29, 30 and 31, respectively, and are driven in each case by a respective servomotor 32, 33, 34 and 35 via bevel gears 36 (FIG. 4). Stepping motors are advantageously used for the servomotors 32–35. Other drives, for example with working cylinders, are also possible. Another drive is described in an exemplary embodiment which also follows. It is advantageous (i.e., avoidance of stops which have to be set, simple implementation of a desired throw-on of printing unit cylinders, and the possibility of automating and changing the setting during printing) if the drive maintains the approached position. For this purpose, the stepping motor is designed as a braking motor, that is, it is held in its position by means of a brake after an actuating movement has been executed. The spindle mechanism, in the form of the threaded nuts 20–23 and threaded spindles 24–27, should not be designed to be self-locking, so that, where winders are concerned, the printing unit cylinders 16–19 can shift aside so as to increase the distance between them. In the case of a winder, after the braking torque of the braking motors has been overcome, these can then be driven by the threaded spindles 24–27.

Fastened to the slides 6 and 9 carrying the form cylinders 16 and 19 are crossmembers 38 and 39, on each of which is arranged an inking rail device 42 and 43 movable in the directions 40 and 41, that is to say in the direction perpendicular to the form cylinders 16 and 19, respectively. An intaglio printing form located on the form cylinders 16 and 19 can be inked in each case by means of the respective inking rail devices 42 and 43. The intaglio printing forms are sleeves 158 and 161 having the printing image in the outer surface. The printing image could also be engraved directly into the outer surface of the cylinder bodies 16.1 and 19.1. The transfer cylinders 17 and 18 carry a transfer form, for example a rubber blanket sleeve, which is a rubber-coated sleeve 159 and 160. However, the cylinder bodies 17.1 and 18.1 may also be equipped with a clamping device for a finite rubber blanket.

The double printing unit operates by the indirect intaglio printing method. In the print throw-on shown in FIGS. 1 to 3, the slides 6–9 are positioned such that the cooperating form and transfer cylinders 16–19 are thrown one onto the other. They are driven in each case by the motor of their associated motor spindle 10–13. The inking rail devices 42 and 43 ink the respective intaglio printing form cylinders 16 and 19 at the image points. The printing image is transferred to the transfer cylinders 17 and 18 by rolling contact respective form cylinders 16 and 19. The transfer cylinders 17 and 18, in turn, during their rolling contact with one another, print on both sides the web 44 which is led through between them. In this case, the transfer cylinders 17 and 18 operate by the so-called rubber/rubber principle, that is to say one cylinder, in addition to performing the function of transferring the printing image, performs the function of the impression cylinder for the other transfer cylinder 18, 17.

Figure 2:
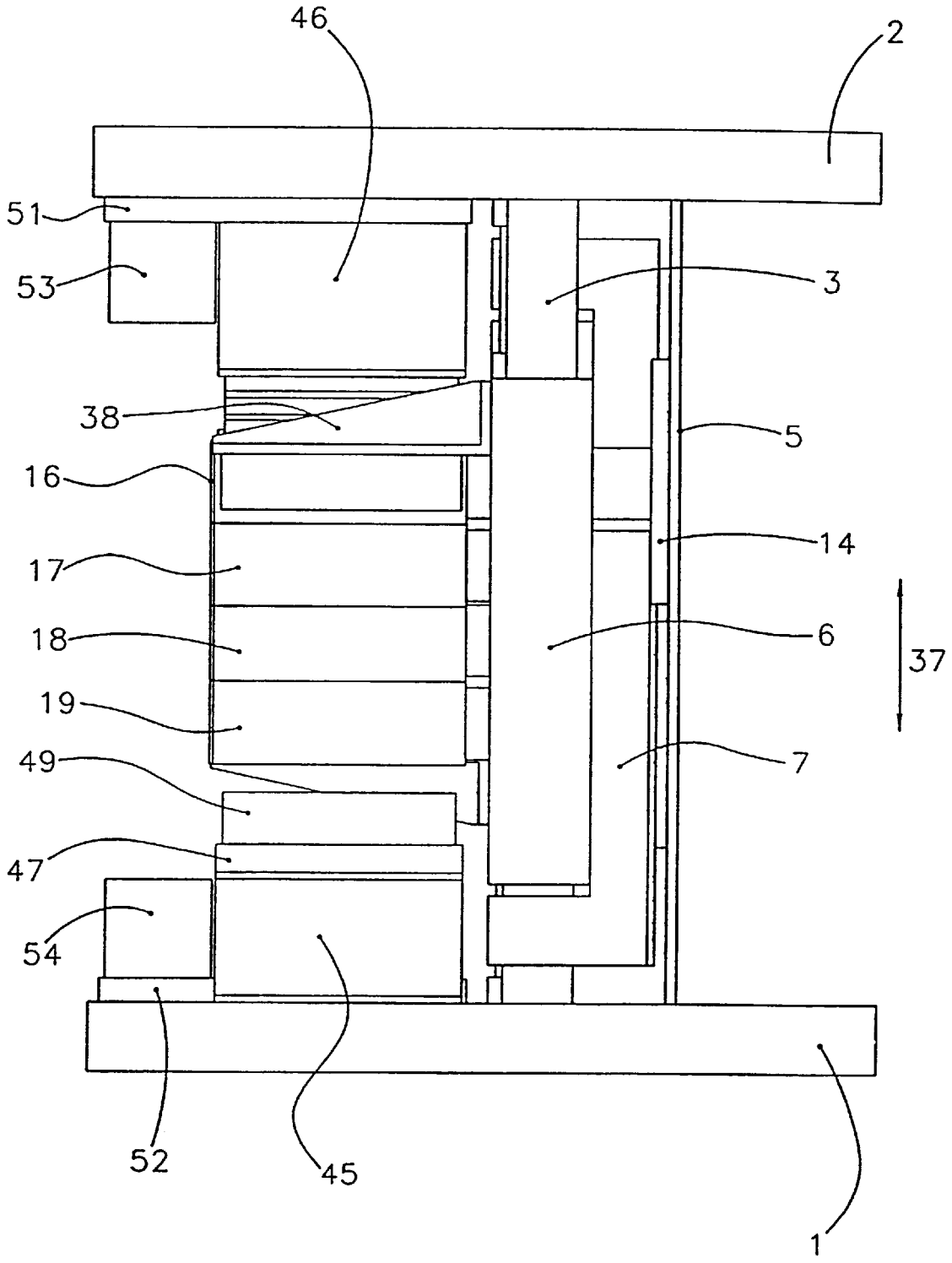
FIG. 2 is a view of the double printing unit taken from the perspective indicated by II in FIG. 1.
Figure 3:
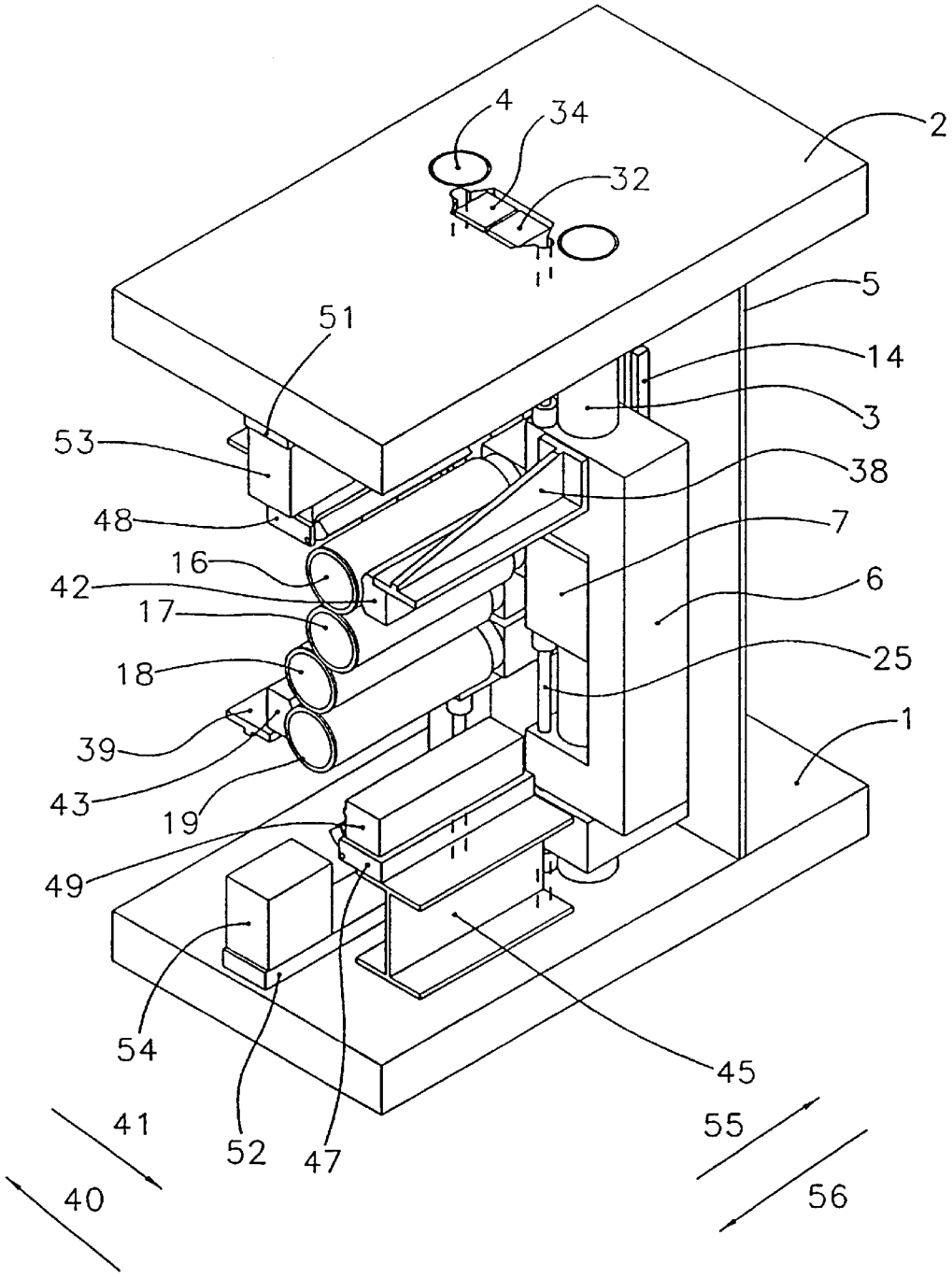
FIG. 3 is a perspective view of the double printing unit according to FIG. 1.

Furthermore, the double printing unit shown in FIGS. 1 to 3 contains subassemblies for producing the printing form in the printing machine, for the so-called CT-press technology (computer-to-press technology). These CT-press components are arranged in a stationary manner. By virtue of the displaceability of the form cylinders 16 and 19, these can be moved into the region of the CT-press components in order to erase and produce a printing form. Said components are arranged in a stationary manner and, if appropriate, have only one degree of freedom of displacement in the direction of the form cylinders 16 and 19 supplied, for adaption to different diameters of the cylinders. In particular, the double printing unit contains two fixed cross members 45 and 46 which are advantageously screwed to the end plates 1 and 2, respectively. Erasing chambers 47 and 48 and a filling chambers 49 and 50 are arranged on the respective cross-members 45 and 46. These erasing and filling chambers 47, 49 and 48, 50 are movable in the directions 40 and 41, respectively, that is transversely to the direction of displacement of the respective form cylinders 16 and 19. Furthermore, a fixed crossmember 51 and 52, each having a respective laser head 53 and 54, is fastened in each case to the respective end plates 2 and 1. The laser heads 53 and 54 are movable in the directions 55 and 56, (i.e., in the direction of the longitudinal axis of the form cylinders 16 and 19 (FIG. 3)). Conversely to what has been said, the erasing and filling chambers 47, 48 and 49, 50 may also be arranged on the end plates 1 and 2, and the laser heads 53, 54 be arranged with a degree of freedom of displacement on the respective crossmembers 46, 45.

Figure 6:
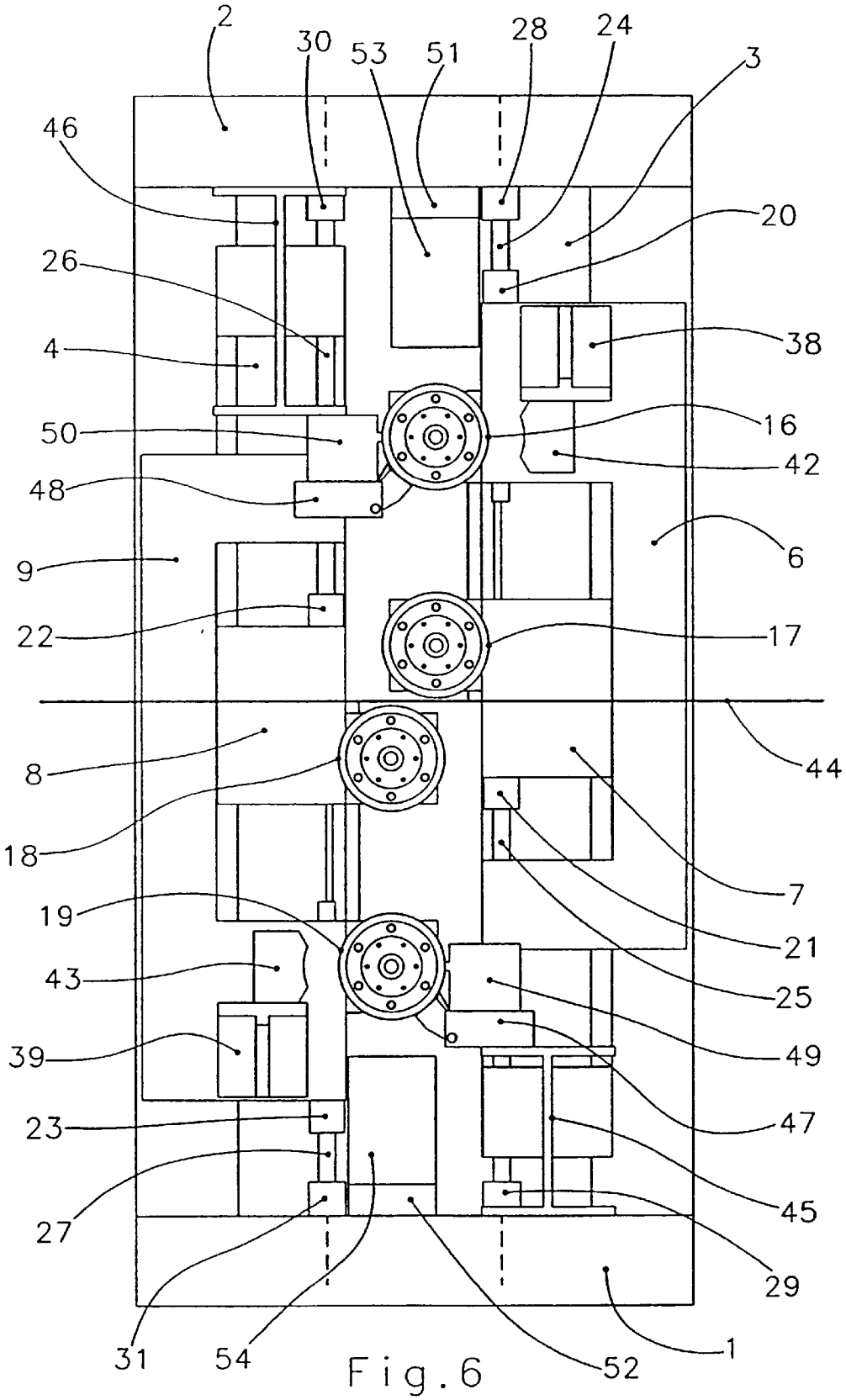
FIG. 6 is a side view of the double printing unit of FIG. 1 having the form cylinders being positioned for erasing and filling the printing form.
Figure 7:
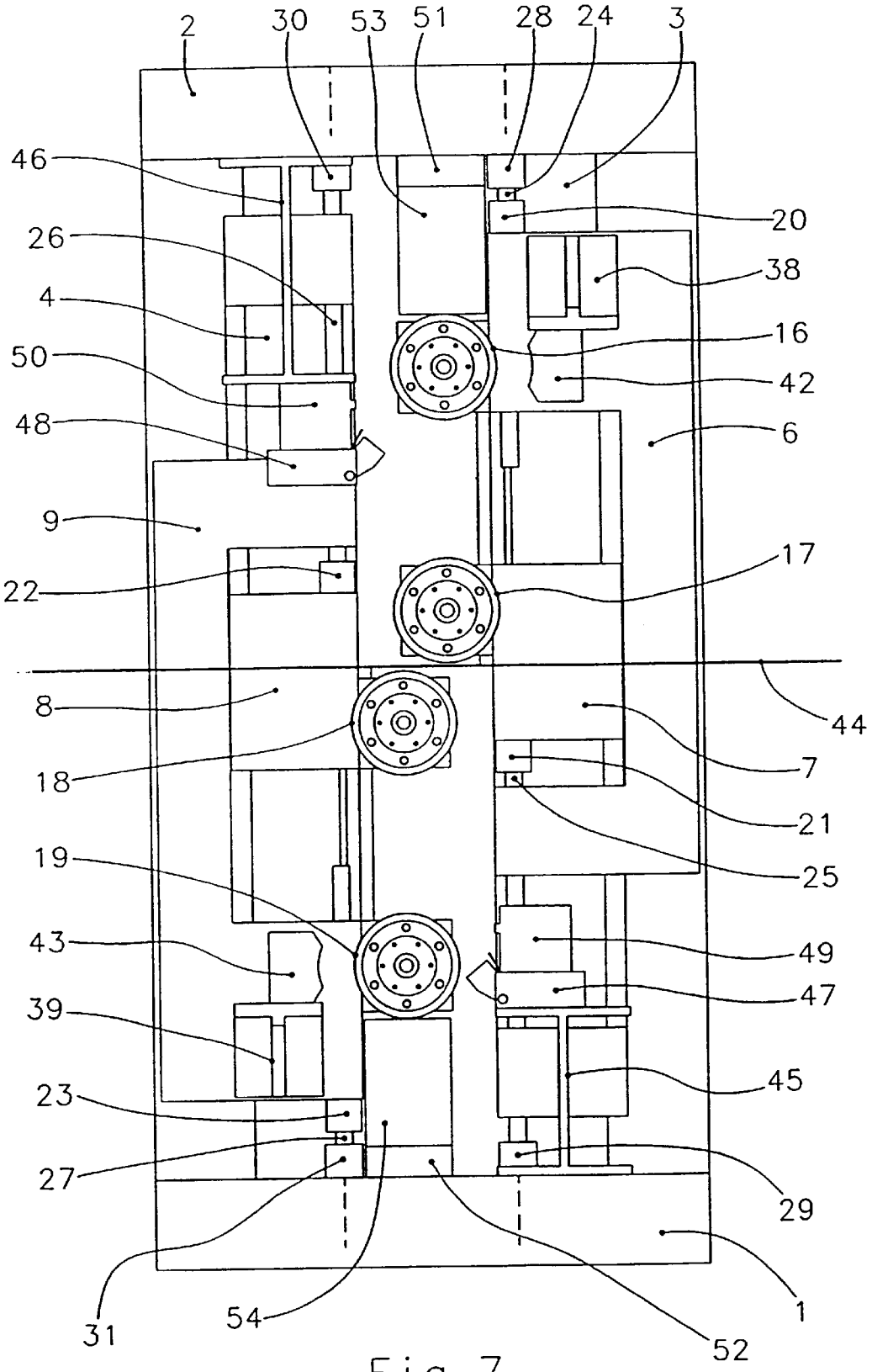
FIG. 7 is a side view of the double printing unit of FIG. 1, having the form cylinders in the imaging position.

In order to produce a new printing form, the form cylinders 16 and 19 are first moved into the positions shown in FIG. 6. This is carried out by corresponding activation of the servomotors 32 and 35 which rotate the threaded spindles 24 and 27 via the bevel gears 36 and thus displace the slides 6 and 9 together with the form cylinders 16 and 19, respectively. Furthermore, in FIG. 6, transfer cylinders 17 and 18 are in print throw-off. This position is approached by activation of the servomotors 33 and 34 which rotate the threaded spindles 25 and 26 via the bevel gears 36 and displace the slides 7 and 8 together with the transfer cylinders 17 and 18, respectively. For the print throw-off of the transfer cylinders 17, 18, it may even be sufficient, in particular cases, to impart throw-off displacement to only one of the transfer cylinders 17, 18. If appropriate, the slide 7, 8 of the other transfer cylinder can then be blocked on its carrier 3, 4 and does not require a drive. After the form cylinders 16, 19 have reached the positions shown in FIG. 6, the erasing and filling chambers 47 and 49 on the crossmember 45 and the erasing and filling chambers 48 and 50 on the crossmember 46 are moved up to the respective form cylinder 16, 19. The erasure of the old intaglio printing forms by means of the erasing chambers 47 and 48 and the refilling of the screen wells by means of the filling chambers 49 and 50 are then carried out in a way known per se. The erasing and filling chambers 47, 49 and 48, 50 are subsequently moved away from the form cylinders 16 and 19 and are brought into the positions shown in FIG. 7 by activation of the respective servomotors 32 and 35. This is the position for the re-imaging of the form cylinders, which is carried out by means of the corresponding movement of the laser heads 53 and 54 in the directions 55 and 56 and control of their laser beams. A suitable CT-press method for producing the printing form is shown, for example, in DE 196 24 441 C1.

Figure 8:
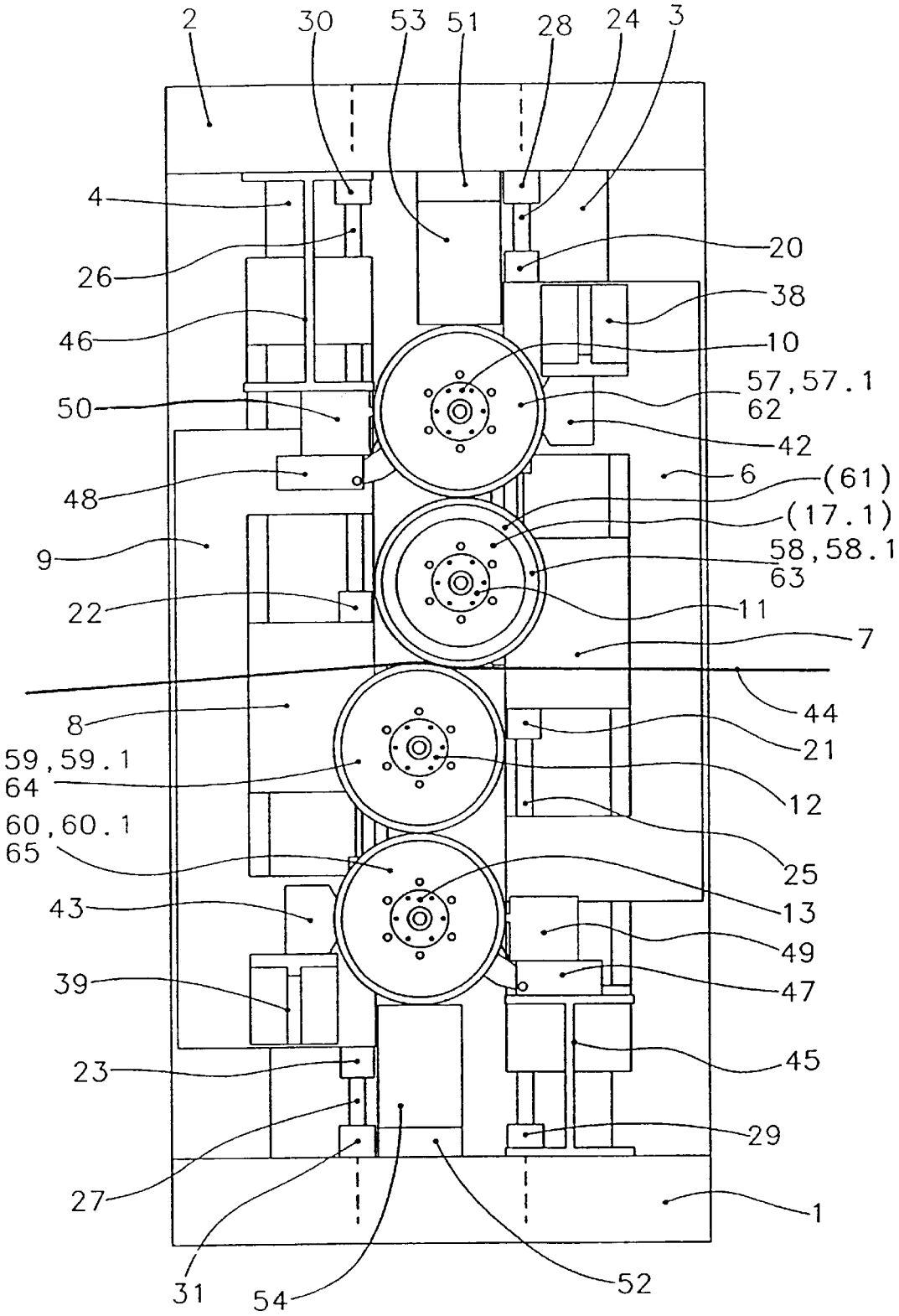
FIG. 8 is a side view of the double printing unit of FIG. 1 having printing unit cylinders of larger diameter.
Figure 9:
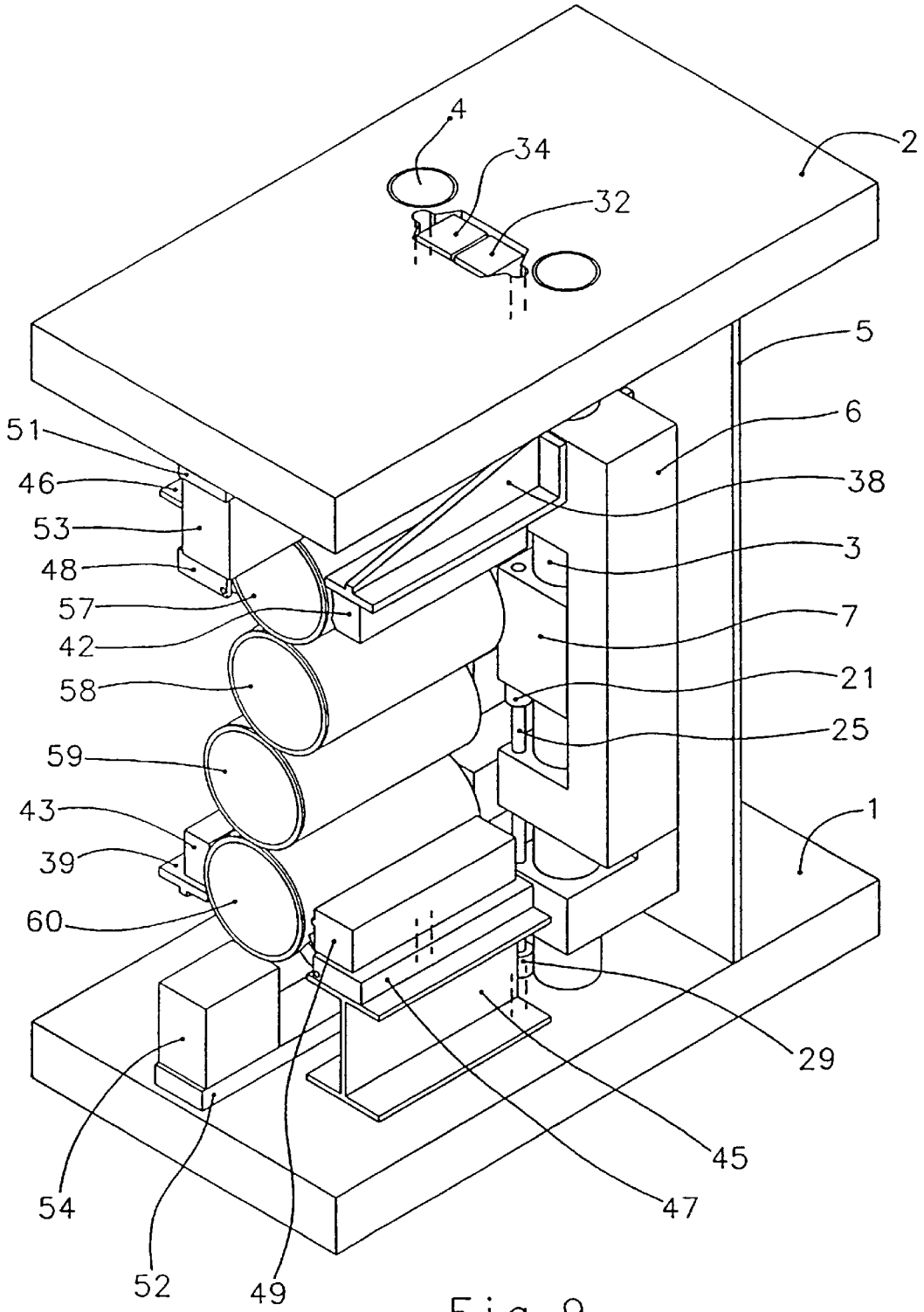
FIG. 9 is a perspective view of the double printing unit according to FIG. 8.
Figure 10:
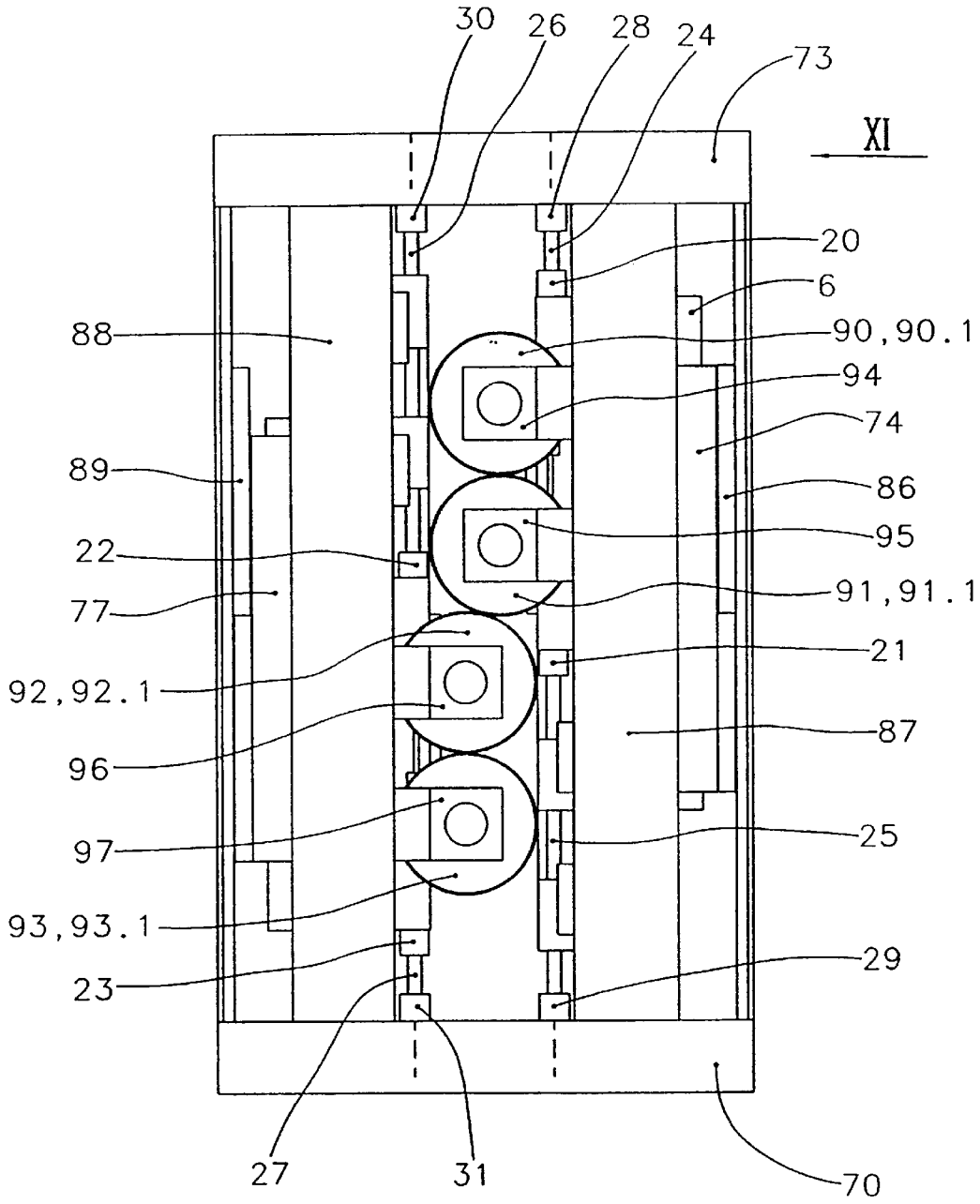
FIG. 10 is a side view of a double printing unit having printing unit cylinders mounted on both sides.

FIGS. 8 and 9 show the double printing unit just described, set up for a larger format, specifically equipped with the largest possible printing unit cylinders 57–60. For this purpose, the respective motor spindles 10–13 are fitted with respective cylinder bodies 57.1–60.1 of correspondingly larger diameter. The components of the double printing unit according to FIG. 1 are otherwise used, unchanged, for which reason the same reference numerals are employed and a detailed description of the design and functioning is dispensed with in order to avoid repetition. The possibility of reuse allows the printing unit to be cost-effectively mass-produced in large quantities for different formats. The form cylinders 57 and 60 are respectively equipped with sleeves 62 and 65 of correspondingly dimensioned diameter, having an intaglio printing form, and the transfer cylinder 58 and 59 are respectively equipped with sleeves 63 and 64 having a transfer form. It is possible to change from one diameter size of the cylinder bodies 16.1–19.1 to another diameter size 57.1–60.1, even in the printing shop, with only little outlay. Furthermore, there is the possibility of converting the printing unit according to FIG. 1 to a printing unit having printing unit cylinders 57–60 of larger diameter while preserving the cylinder bodies 16.1–19.1. This is performed by sleeves of correspondingly large outside diameters being drawn onto the cylinder bodies 16.1–19.1. In FIG. 8, such a transfer sleeve 61 in on the cylinder body 17.1 is indicated, thinly drawn, for example on the transfer cylinder 58.

Figure 13:
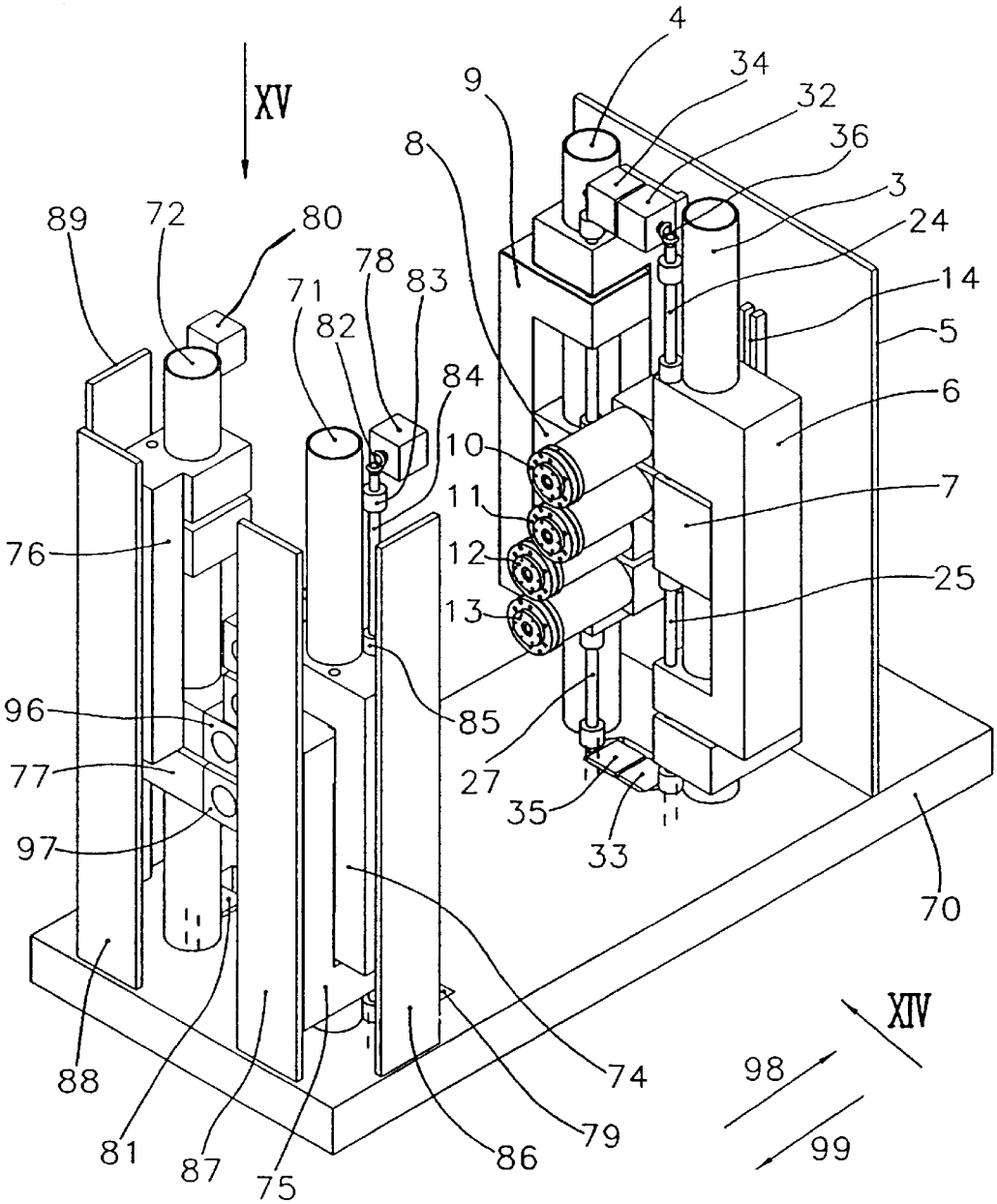
FIG. 13 is the double printing unit of FIG. 12, having the cylinder bodies, inking units, an end plate and components for printing form production being omitted.
Figure 14:
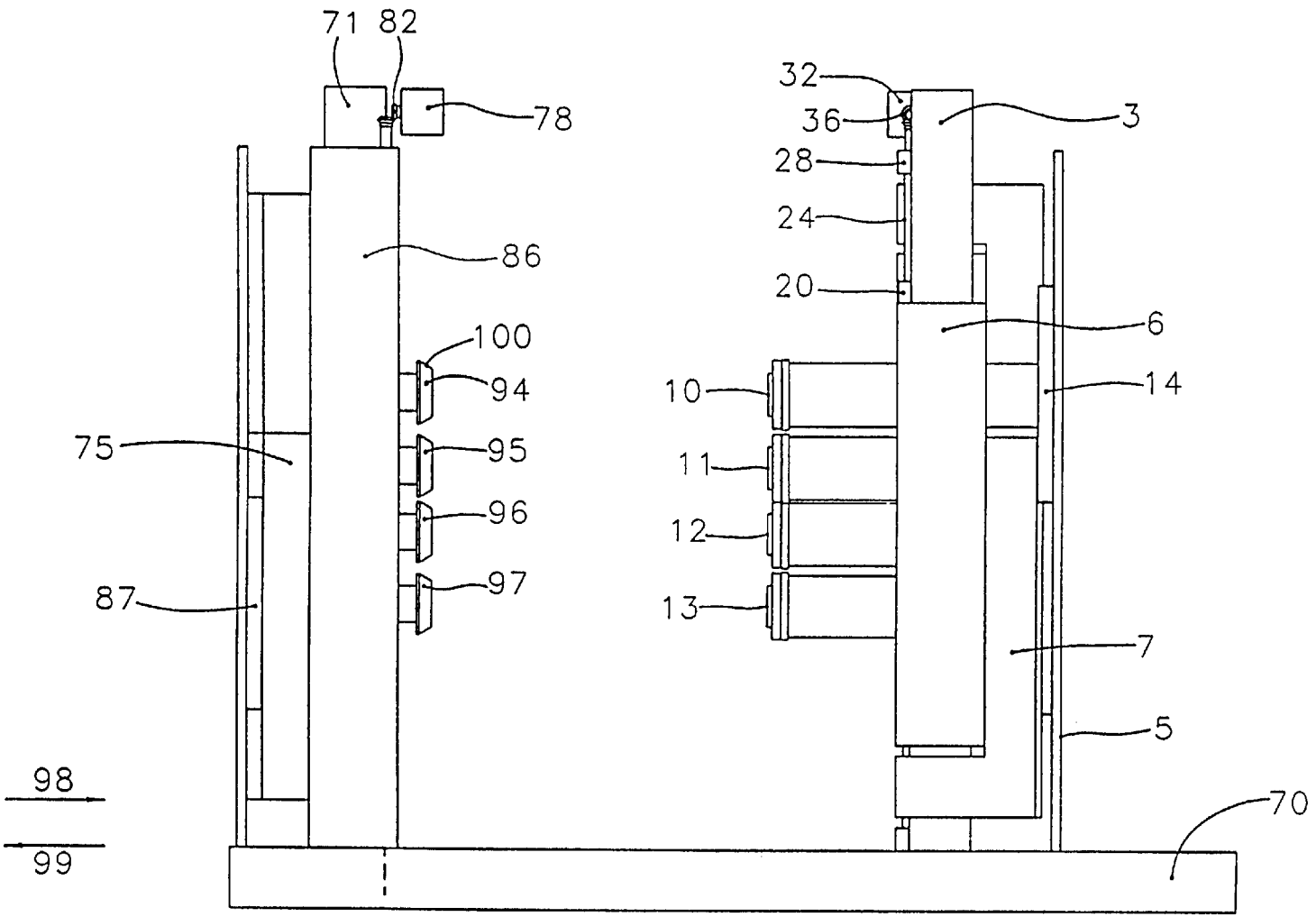
FIG. 14 is a side view of the double printing unit taken from the view XIV of FIG. 13.
Figure 15:
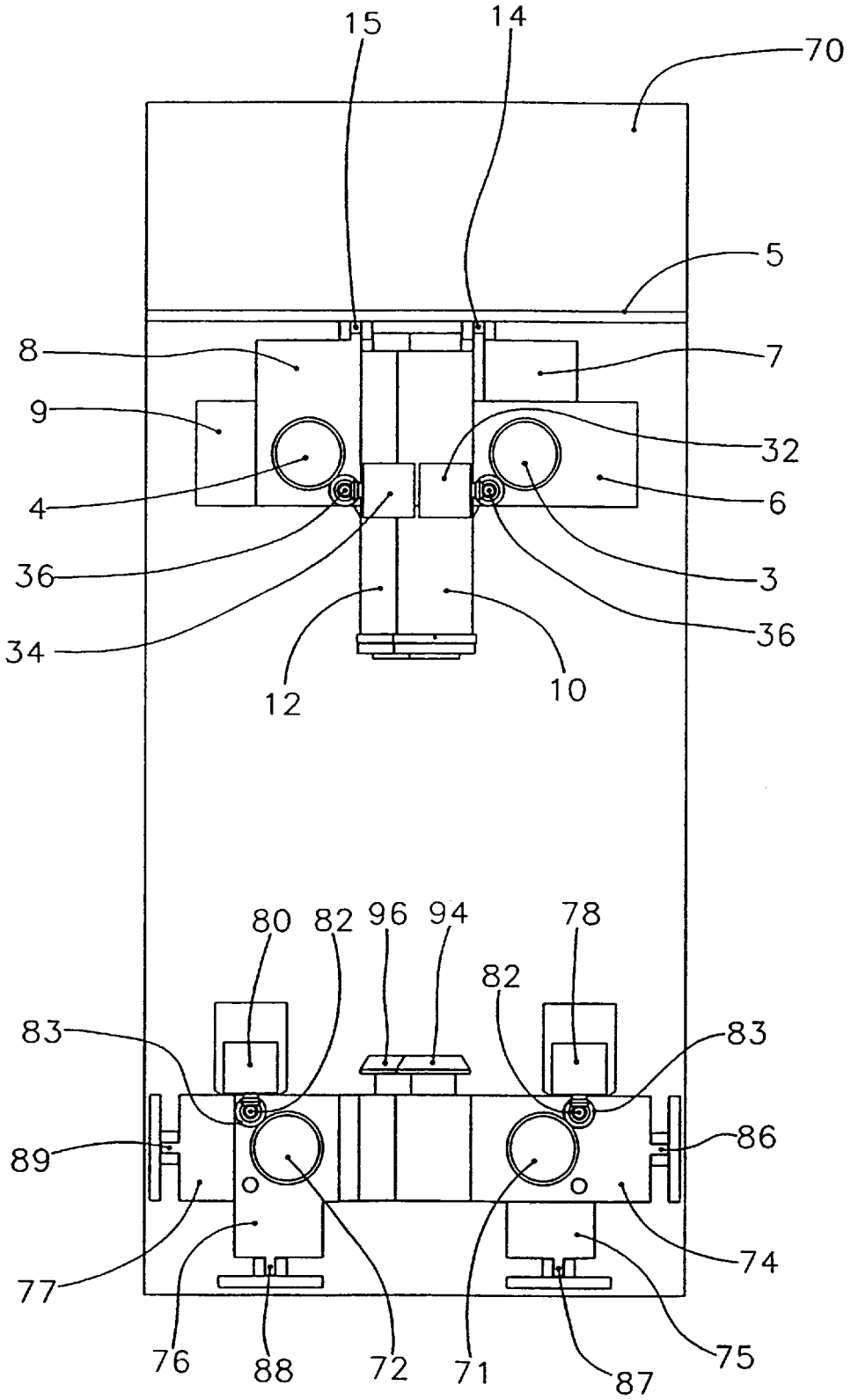
FIG. 15 is a top view of the double printing unit taken from the view XV of FIG. 13.

FIGS. 10 to 15 show a double printing unit which, as compared with the printing unit according to FIG. 1, is distinguished by a larger printing width. The printing unit cylinders 90–93 are wider and make it possible to print a correspondingly wider web. The printing unit cylinders are, in particular, the form cylinders 90 and 93 and the transfer cylinders 91 and 92. These printing unit cylinders 90–93 are advantageously mounted on both sides, that is to say not overhung, due to their larger width. In this case, the components of the mounting already described (FIG. 1) are used, unchanged, which provides for the possibility, already mentioned, of cost-effective production in relatively large quantities. The previous reference numerals are maintained for identical components which recur. These are the carriers 3, 4, on which the slides 6–9 are displaceably arranged by means of the motor spindles 10–13. Furthermore, the plate 5 with the flat guides 14, 15, the spindle nuts 20–23, threaded spindles 24–27, axial bearings 28–31, servomotors 32–35 and the bevel gears 36 are employed. The displacement of the slides 6–9 takes place in the same way as in FIG. 1. In light of the larger cylinder width, two wider end plates 70, 73 are fastened to the carriers 3, 4, and two additional carriers 71, 72 are tied to said end plates. Slides 74, 75 and 76, 77 are displaceably arranged on the respective carriers 71 and 72 in a similar way to the carriers 3, 4. The displacement of the slides 74–77 takes place in the same way as that of the slides 6–9. For this purpose, servomotors 78, 79, 80 and 81 are provided, which are drive-connected to a respective slide 74, 75, 76 and 77 in each case via a bevel gear 82, a threaded spindle 84 with axial bearing 83 and a spindle nut 85 (FIGS. 13, 15). The movement of the slides 74–77 takes place synchronously with the movement of the slides 6–9. For this purpose, the servomotors 78–81 are activated in the same way as the servomotors 32–35. The slides 74, 75, 76 and 77 are secured against rotation in each case by means of flat guides 86, 87, 88 and 89, respectively, (FIG. 15) which resemble the flat guides 14, 15.

Figure 11:
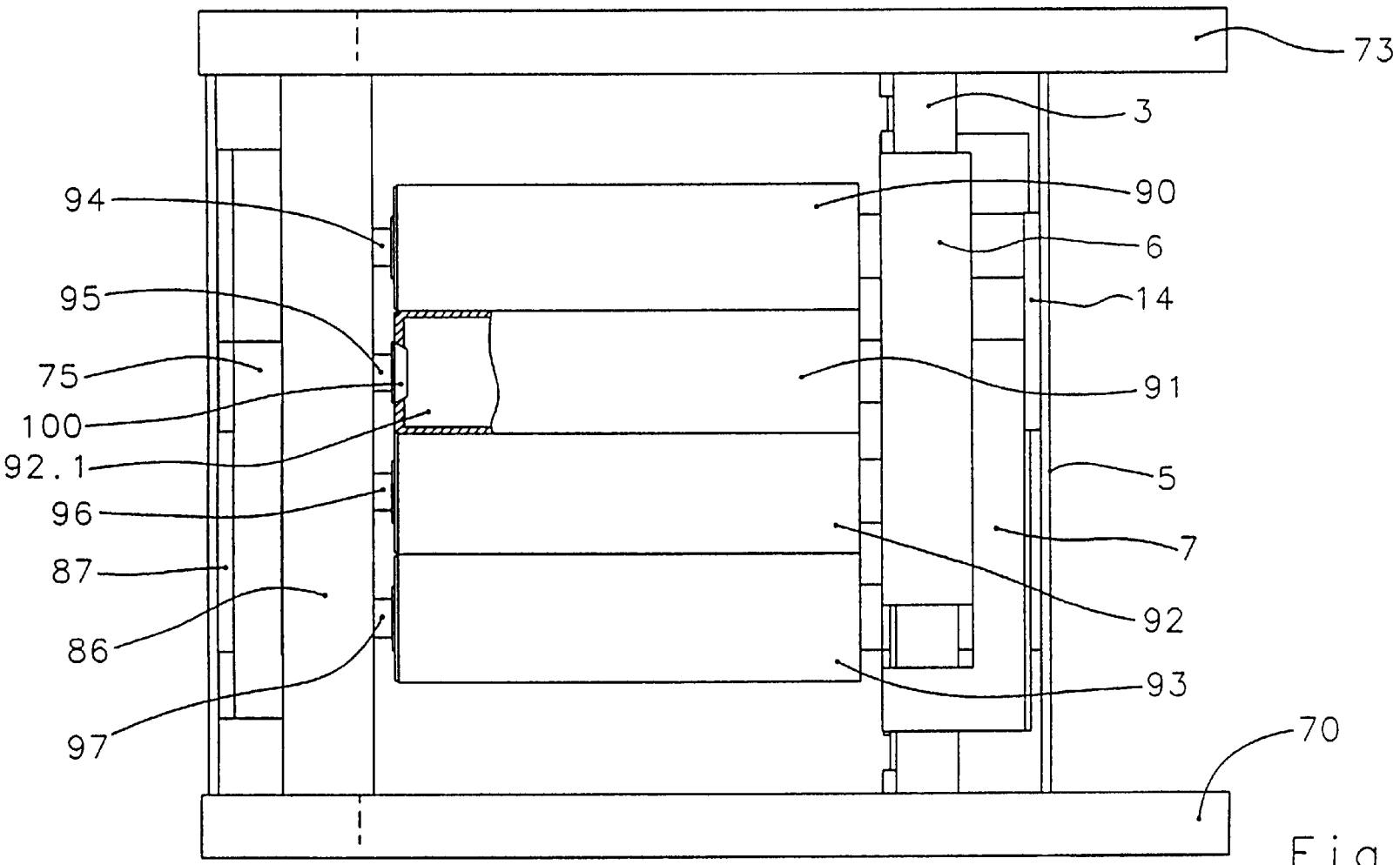
FIG. 11 is a view of the double printing unit of FIG. 10 taken from the perspective indicated by XI.
Figure 12:
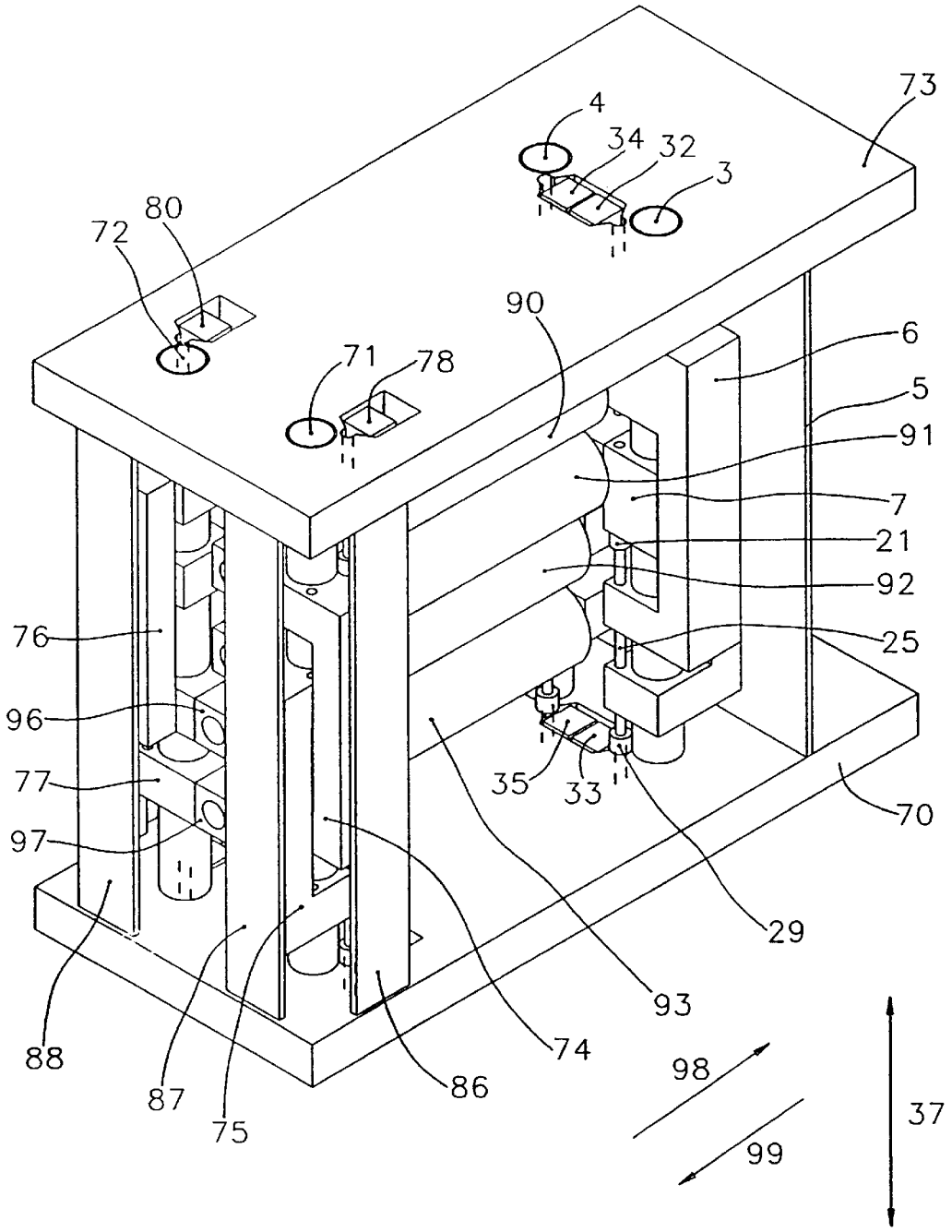
FIG. 12 is a perspective of the double printing unit of FIG. 10.

The printing unit cylinders 90–93 contain cylinder bodies 90.1–93.1 which are screwed in each case to a motor spindle 10–13, respectively. On the opposite side, the cylinder bodies 90.1, 91.1, 92.1 and 93.1 are supported by tailstock-like support mountings 94, 95, 96 and 97, respectively, which are fastened to the respective slides 74, 75, 76 and 77. The support mountings 94–97 are designed such that they can be moved in the directions 98 and 99 by means of servomotors (not shown), so that they can be moved with their cone 100, located in each case at the end, into correspondingly conically designed receptacles of the cylinder bodies 90.1–93.1 and support the latter (FIG. 11). It goes without saying that the printing unit cylinders 90–93 may also be designed differently in this and the following exemplary embodiments. For example, the printing unit cylinders may have journals, by means of which they are mounted in the slides 6–9 and 74–77.

For the purpose of providing of a clearer illustration of the components described, the upper end plate 73 and the cylinder bodies 90.1 to 93.1 have been omitted in FIGS. 13 to 15. Moreover, inking units and CT-press components have not been illustrated in FIGS. 10 to 15. The double printing unit, in turn, is designed for indirect intaglio printing, that is to say inking rail devices, not illustrated, can be thrown onto the form cylinders 90 and 93. Instead, the double printing unit could, for example, also be equipped for offset printing. In the present case, the form cylinders 90 and 93 therefore carry intaglio printing forms and the transfer cylinders 91 and 92 carry transfer forms. Sleeve-like printing forms and transfer forms are advantageously employed.

Figure 16:
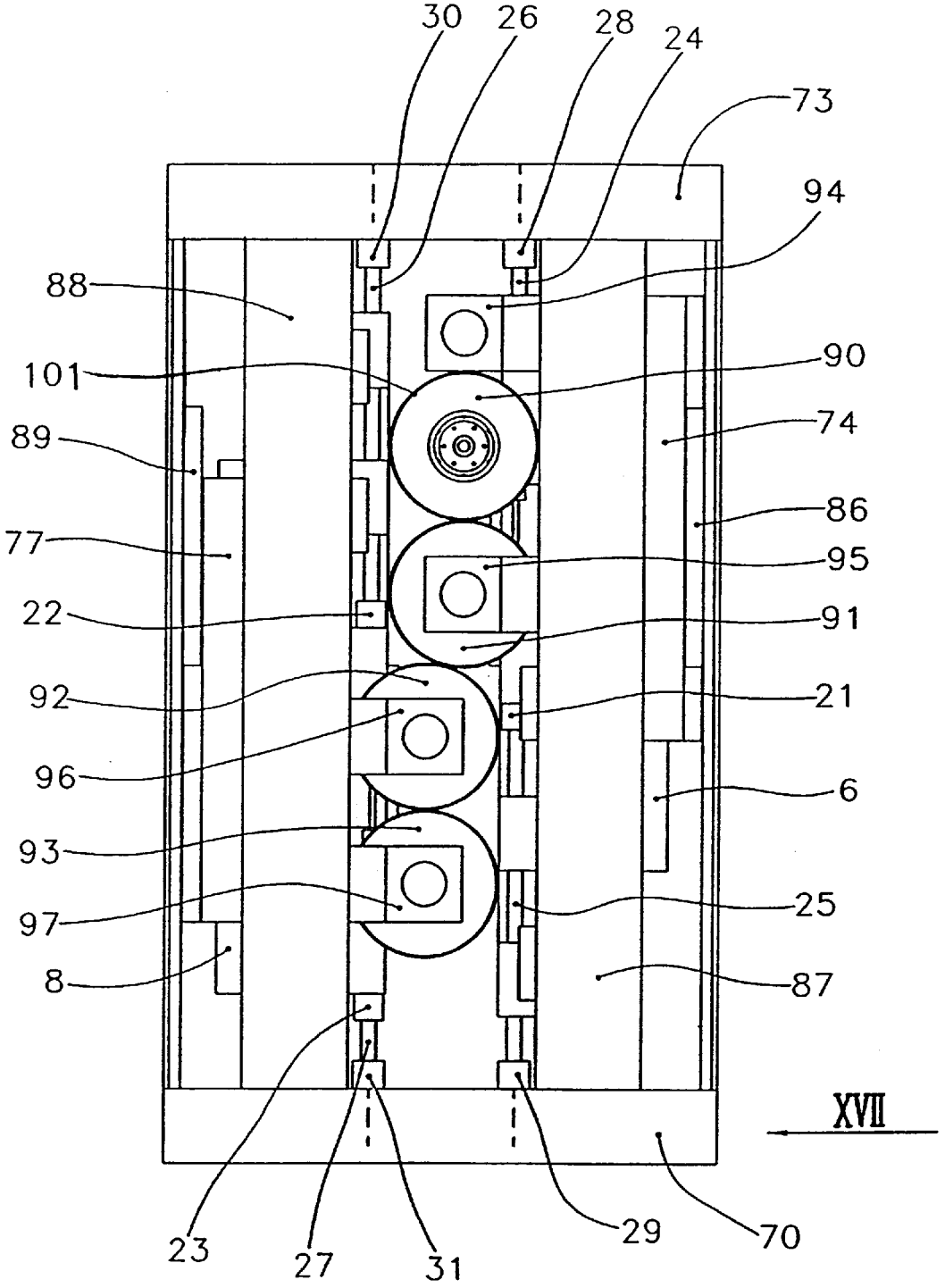
FIG. 16 is a side view of the double printing unit according to FIG. 10, having the form cylinder freed for the purpose of changing a printing form sleeve.
Figure 17:
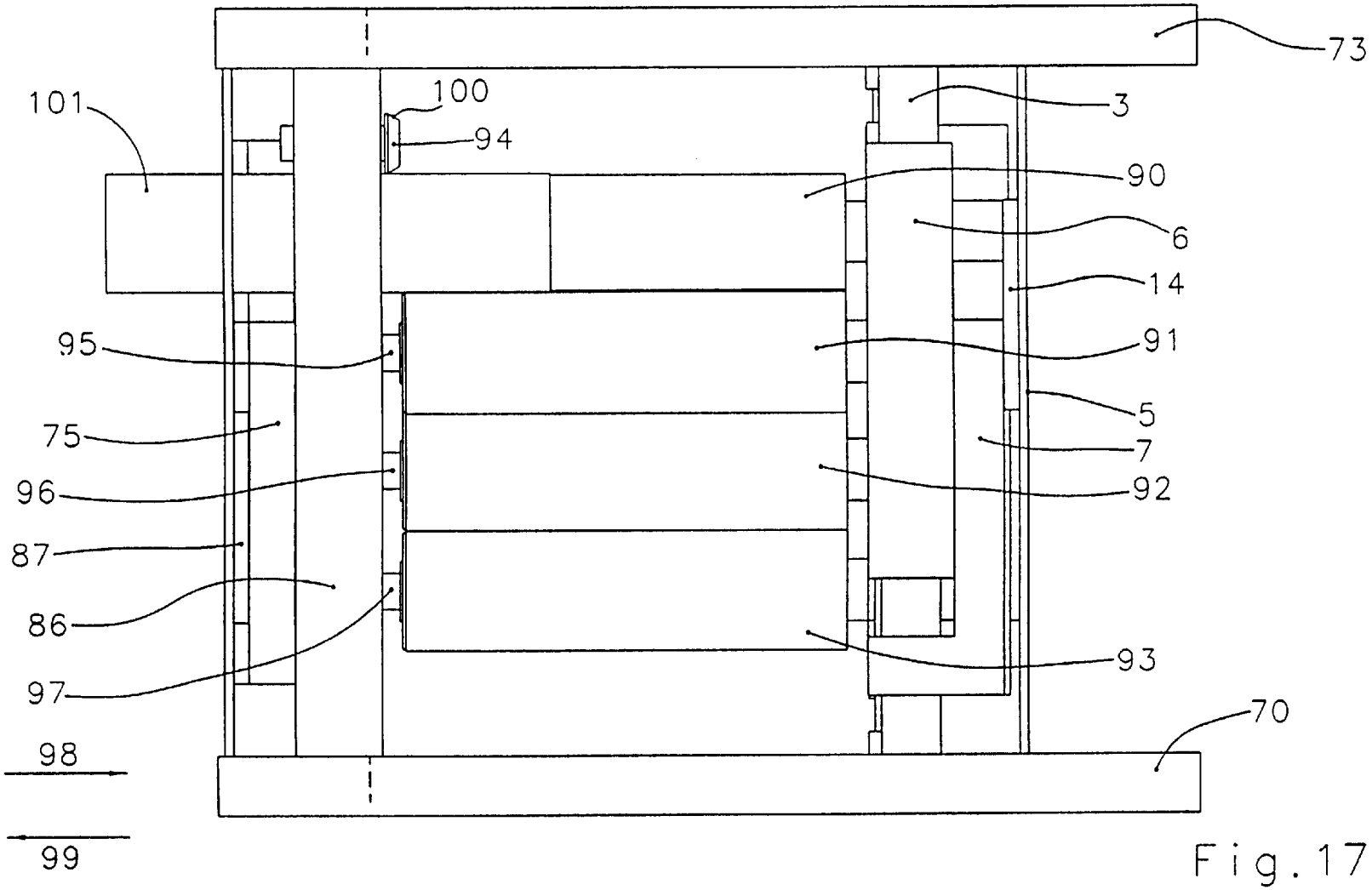
FIG. 17 is a view of the double printing unit of FIG. 16 taken from the perspective indicated by XVII.
Figure 18:
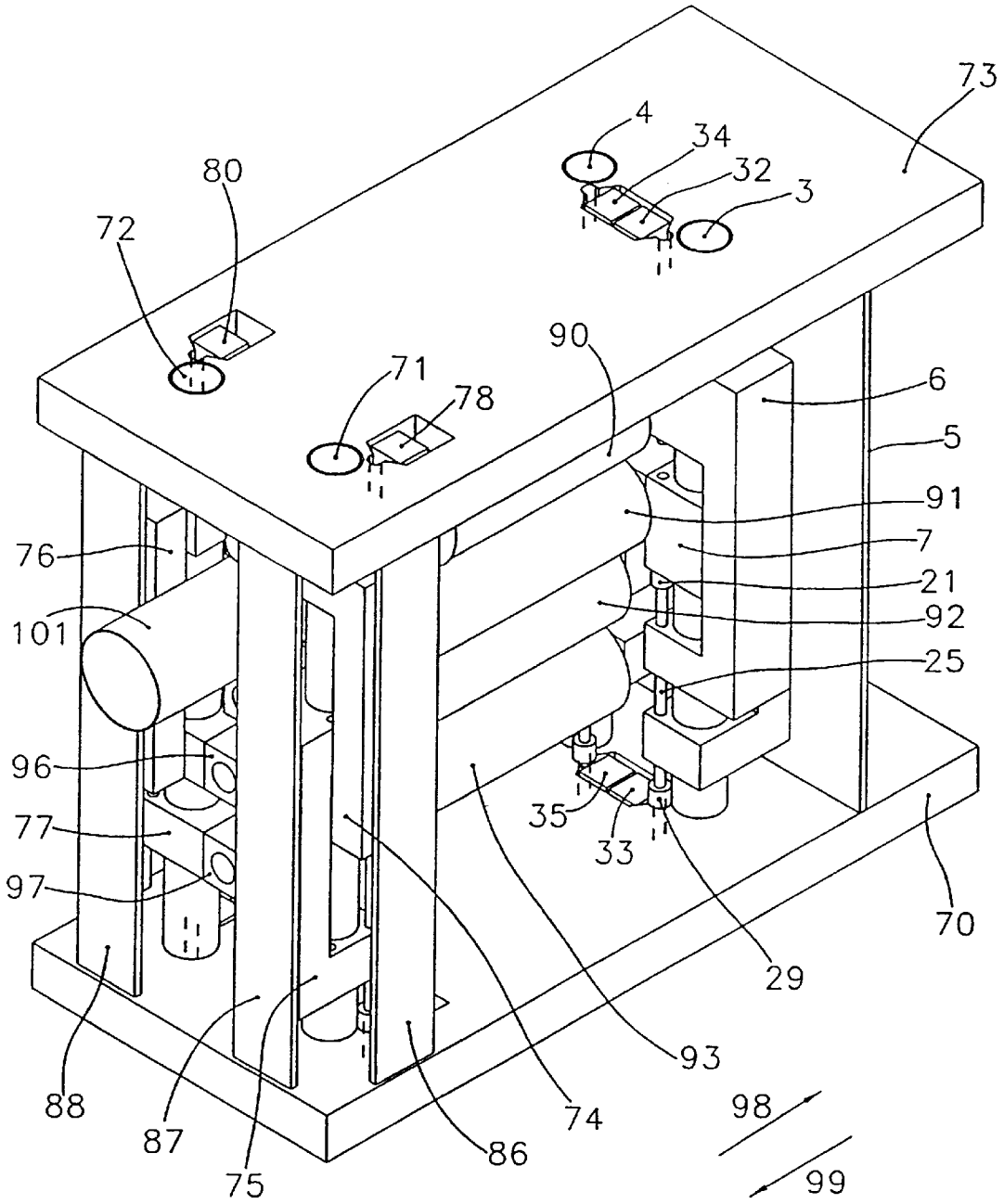
FIG. 18 is an illustration of the changing of a printing form sleeve on the double printing unit according to FIG. 16.

FIGS. 16 to 18 illustrate the change of a sleeve 101 located on the form cylinder 90 and having an intaglio printing form. An identical sleeve is located on the form cylinder 93. In order to extract sleeve 101, the form cylinder 90 is first freed on one side. For this purpose, first, the cone 100 of the support mounting 94 is axially moved in the direction 99 and drawn out of the conical receptacle of the form cylinder 90. Subsequently, by activation of the servomotor 78, the slide 74, together with the support mounting 94, is moved upward, so that the latter assumes the position shown in FIGS. 16 and 17. The form cylinder 90 is consequently freely accessible from this end face and is overhung in the slide 6 by means of the motor spindle 10. The sleeve 101 is axially removed from the form cylinder 90, and a new sleeve is pushed on. The displaceability of the sleeve 101 on the form cylinder 90 is advantageously afforded by the elastic expansion of said sleeve by means of compressed air.

Solutions from the prior art are known, for this purpose, to the average person skilled in the art. After the sleeve has been changed, the slide 74 is moved back by activation of the servomotor, until the cone 100 resumes a concentric position in relation to the form cylinder 90. The support mounting 94 is subsequently moved in direction 98 and the cone 100 is moved into the receptacle of the form cylinder 90. In order to change the sleeves on the transfer cylinders 91 and 92 and the form cylinder 93, a similar procedure is carried out by moving the support mountings 95–97. In order to free the end faces of the transfer cylinders 91 and 92, the support mounting 94 or 97 of the adjacent form cylinder 90 and 93 must first be moved away, or these form cylinders 90 and 93, complete, are moved away. The carriers 71 and 72 together with the slides 74, 75 and 76, 77 are at such a distance from one another that the sleeves 101 to be changed can be led through between them (FIG. 18).

Figure 19:
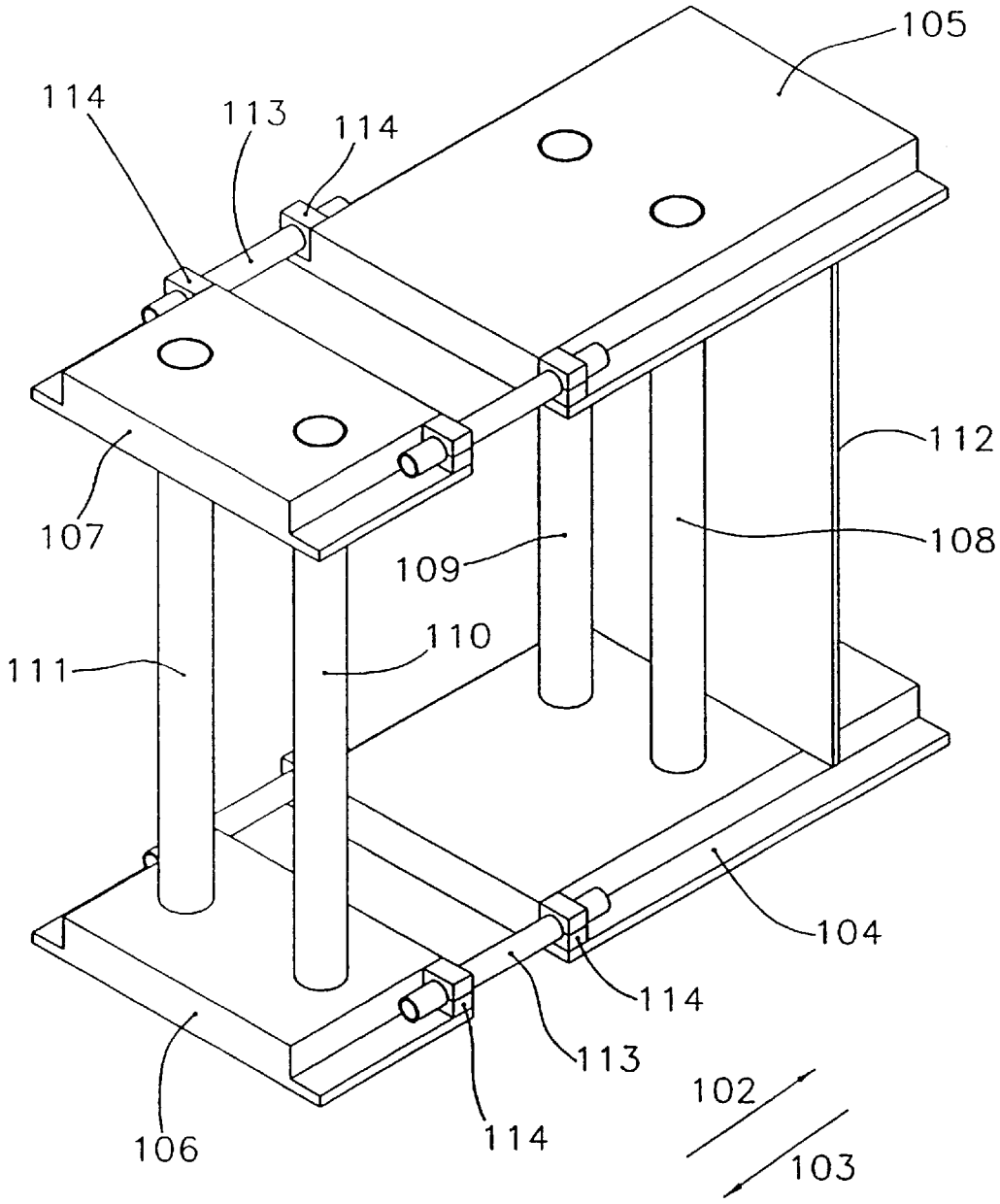
FIG. 19 is a perspective view of split version of the end plates of a printing unit according to the invention.

FIG. 19 shows the variable-width version of a printing unit. For the sake of simplicity, only the stand is illustrated. Here, the end plates are transversely split, in each case into a left and a right individual plate 104, 106 and 105, 107. Of the carriers 108 to 111 for the mounting of printing unit cylinders on two sides, the carriers 108 and 109, as well as a plate 112, are fastened to the individual plates 104 and 105 and the carriers 110 and 111 are fastened to the individual plates 106 and 107. The individual plates 104, 106 and 105, 107 are connected to one another in each case via cross-members 113 clampable in clamping pieces 114. When the clamping pieces 114 are in the loosened state, the individual plates 104, 106 and 105, 107 can be displaced toward one another and away from one another in the directions 102 and 103. The distance between them can therefore be adjusted according to the required distance between the slides located on the carriers 108 to 111 (not shown), for the purpose of mounting printing unit cylinders of different width. Thus, for example, the printing unit cylinders 90–93 of FIG. 11 can be mounted in the stand shown in FIG. 19. However, even wider printing unit cylinders may also be mounted, if the individual plates 104, 106 and 105, 107 are mounted at a greater distance from one another for this purpose.

Figure 20:
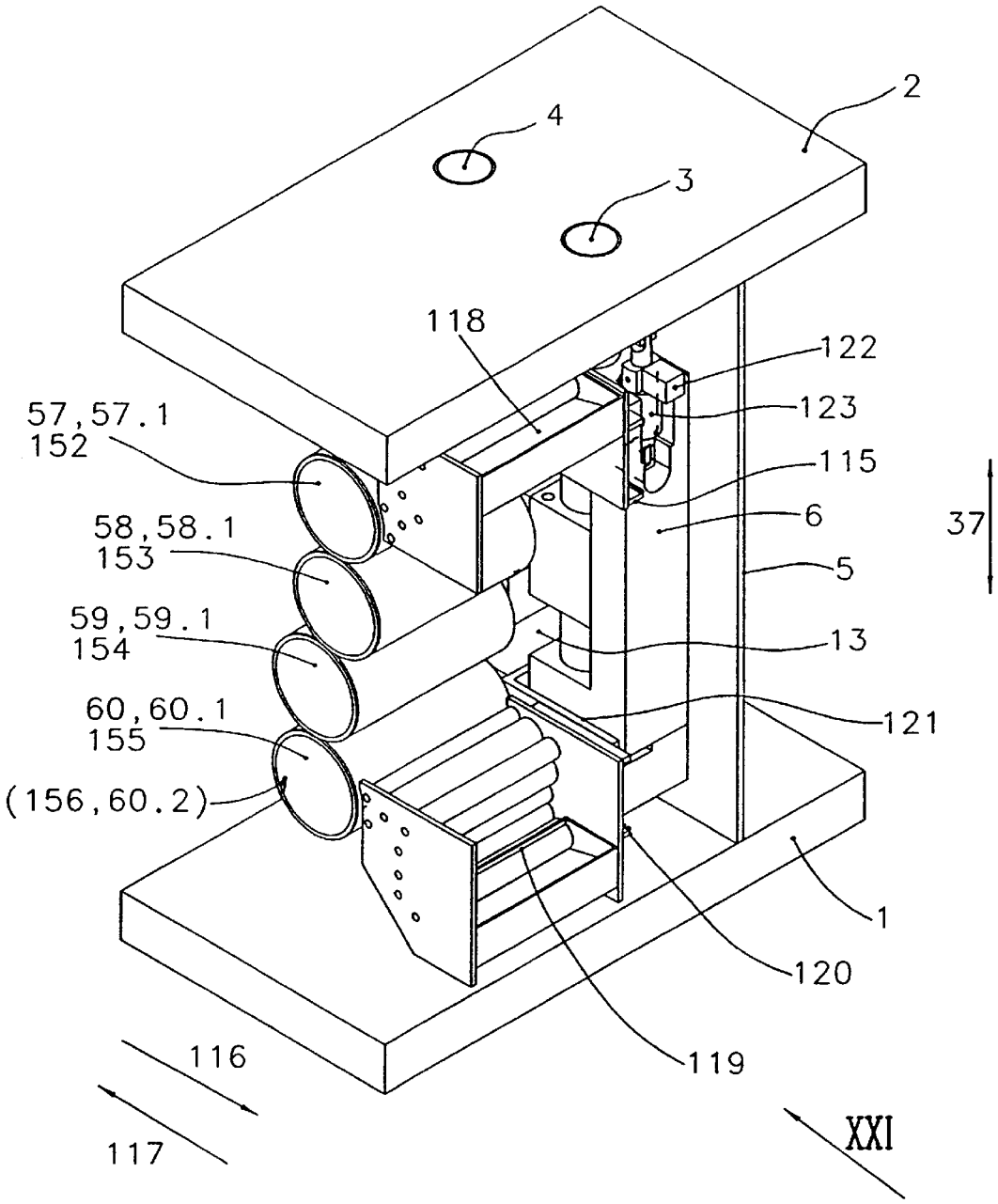
FIG. 20 is a perspective view of a double printing unit for offset printing, having a further drive variant for the slides according to the invention.
Figure 21:
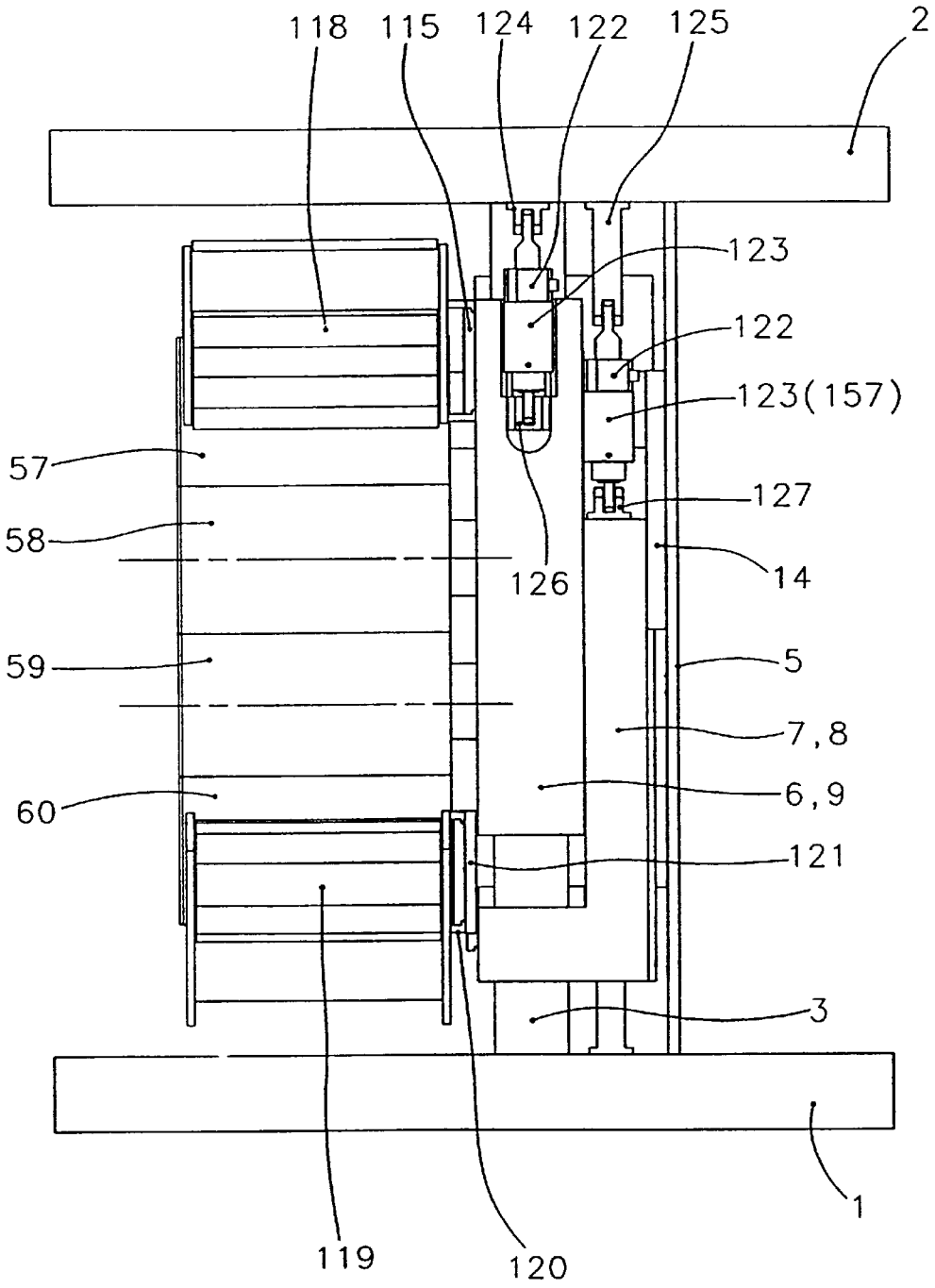
FIG. 21 is a side view of the double printing unit of FIG. 20 taken from the perspective indicated by XXI.

The double printing units described were designed as intaglio printing units. These printing units may also be designed so as to be equipped with other components, for example for the offset method. In this case, the components necessary for printing, such as, for example, inking and dampening units, are likewise fastened to the slides 6–9 and consequently can be moved together with the printing unit cylinders, while the so-called CT-press components for imaging (production of an offset printing form) are fastened in a stationary manner in the printing unit and are approached by the respective printing unit cylinders. FIGS. 20 and 21 illustrate such an offset double printing unit, the basic design corresponding to the printing unit according to FIG. 8 (or FIG. 1). The previous reference numerals continue to be used for individual parts which recur. These parts are also, in fact, identical, thus allowing them to be advantageously produced in relatively large quantities, as already mentioned. Once again, the end plates 1, 2 are used, between which the carriers 3, 4, together with the plate 5, extend. The slides 6–9 together with the form cylinders 57 and 60 and with the transfer cylinders 58 and 59 are displaceably arranged on the carriers 3, 4 in a similar way to FIG. 8. An offset inking unit 118 and 119 is thrown in each case onto the form cylinders 57, and 60, respectively. The offset inking units 118 and 119 are designed as modules and, with a respective guide 115 and 121 being interposed in each case, are arranged on the respective slide 6, 9 which carries the corresponding form cylinder 57, 60. The guides 115 and 121, which allow movements in the directions 116, 117, make it possible to adapt to cylinder diameters of different size. The offset inking units 118, 119 or modules optionally also contain a dampening unit. Compared with the printing unit according to FIG. 8, the sleeves, with intaglio printing forms 62 and 65, of the respective form cylinders 57 and 60 are respectively exchanged for sleeves with offset printing forms 152 and 155 and the sleeves, with transfer forms 63 and 64, of the transfer cylinders 58 and 59 are exchanged for other sleeves with transfer forms 153 and 154, respectively. However, the printing unit may also be designed, for example, with finite offset printing plates. For this purpose, cylinder bodies with an appropriate clamping system must then be used instead of the cylinder bodies 57.1 and 60.1 for receiving sleeve-like printing forms. In FIG. 20, the variation of a cylinder body 60.2 with slot clamping, in conjunction with an offset printing plate 156, is indicated by thin lines on the form cylinder 60.

Furthermore, FIGS. 20 and 21 show another drive variation for the slides 6–9. The slides 6–9 are driven in each case by means of a hydraulic cylinder 123 actuable by means of a stepping motor 122. These actuable hydraulic cylinders 123 are supported on the end plate 2 in each case by means of a holder 124, 125 and on the slides 6 and 7 by means of a respective holder 126 and 127. In the case of commercially available actuable hydraulic cylinders 123 of this type, the actuating travel, which the hydraulic cylinder 123 follows, is predetermined by means of the stepping motor 122. Commercially available electromechanical actuating units could also be used for driving the slides 6–9. Actuating units of this type contain, for example, a stepping motor which moves a push element with high sensitivity via a screw mechanism. Such an electromechanical actuating unit 157 is indicated by way of example in FIG. 21 by the reference numeral placed in brackets. Both the actuable hydraulic cylinders 123 and the electromechanical actuating units 157 maintain the approached positions. Nevertheless, as a result of overload protection which can be simply provided, they may depart from the specified position if predetermined forces are exceeded. Thus, where winders are concerned, good protection against machine damage is possible. The slides 6–9 are driven by means of the hydraulic cylinders 123 or the electromechanical actuating units 157 in a similar way to the drive by means of the servomotors 32 to 35 according to FIG. 1, and, so as to avoid repetition, there is therefore no need for more detailed explanations.

Figure 22:
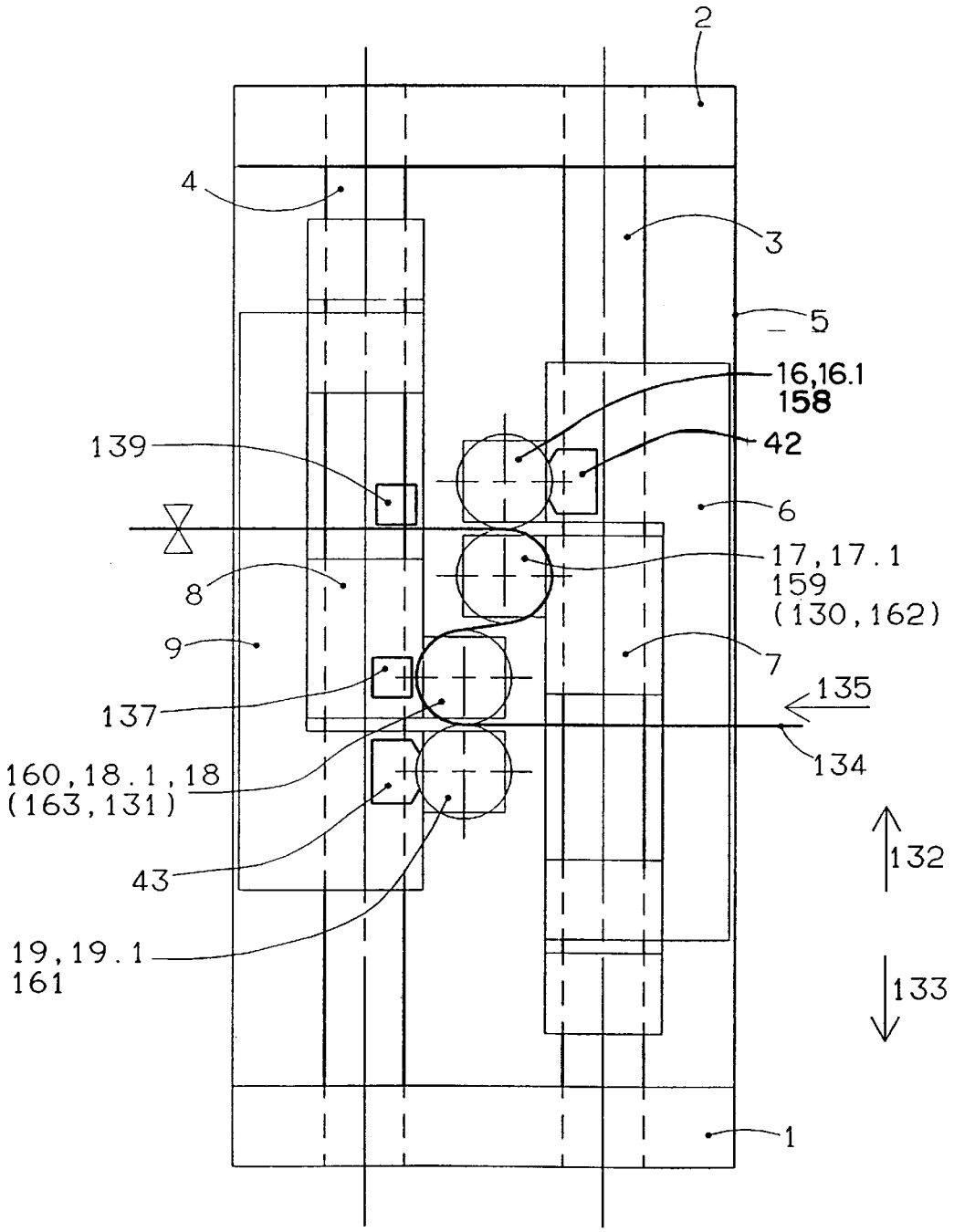
FIG. 22 is a side view of a printing unit for direct intaglio printing according to an embodiment of the invention.

FIG. 22 shows a double printing unit which is set up for direct intaglio printing. It essentially contains the components of the double printing unit according to FIG. 1. The positions of the printing unit cylinders 16–19 have been changed. In particular, the transfer cylinders 17 and 18 have been set at a distance from one another by means of the slides 7 and 8 displacing them in the directions 132 and 133. The form cylinders 16 and 19 have also been correspondingly displaced in the directions 132 and 133 by means of the slides 6 and 9. It would also be possible to leave the transfer cylinder 18 and the form cylinder 19 in the positions shown in FIG. 1 and position only the transfer cylinder 17 and the form cylinder 16 so as to be displaced in the direction 132. The sleeves 158 and 161 having intaglio printing forms are left on the cylinder bodies 16.1 and 19.1 of the form cylinders 16 and 19. The transfer cylinders 17, 18 likewise keep sleeves 159 and 160 having transfer forms on their respective cylinder bodies 17.1 and 18.1. If appropriate, however, said sleeves may also be replaced in each case by a sleeve 162, 163 having an impression surface (coating) and, consequently, the transfer cylinders 17, 18 are converted into special impression cylinders 130, 131. This variation is indicated by reference numerals given in brackets. An inking rail device 42 and 43 is thrown onto the respective form cylinders 16 and 19. The double printing unit according to FIG. 1 can be set up in the printing shop as the version, shown in FIG. 22, for direct intaglio printing, but it can also be assembled in this version at the factory. The other components shown in FIG. 1 and CT-press components are likewise used in the double printing unit according to FIG. 22, but are not illustrated and described again for the sake of simplicity.

The web 134 is first led in direction 135 through and between the form cylinder 19 and the transfer cylinder 18, serving as an impression cylinder, and at the same time is printed on one side by the printing form inked by means of the inking rail device 43. During the further run, the print is dried by a drier 137 and the web is subsequently led through and between the transfer cylinder (impression cylinder) 17 and the form cylinder 16 and at the same time printed on the opposite side by means of the intaglio printing form inked by the inking rail device 42. This print, too, is subsequently dried by a drier 139. For print throw-off, it is sufficient to move the form cylinder 16 in direction 132 by displacement of the slide 6 and move the form cylinder 19 in direction 133 by displacement of the slide 9. The printing unit shown in FIG. 22 can also be set up, for example, for offset printing, as a result of which a web can then be printed on both sides by the so-called direct lithography method.

Figure 23:
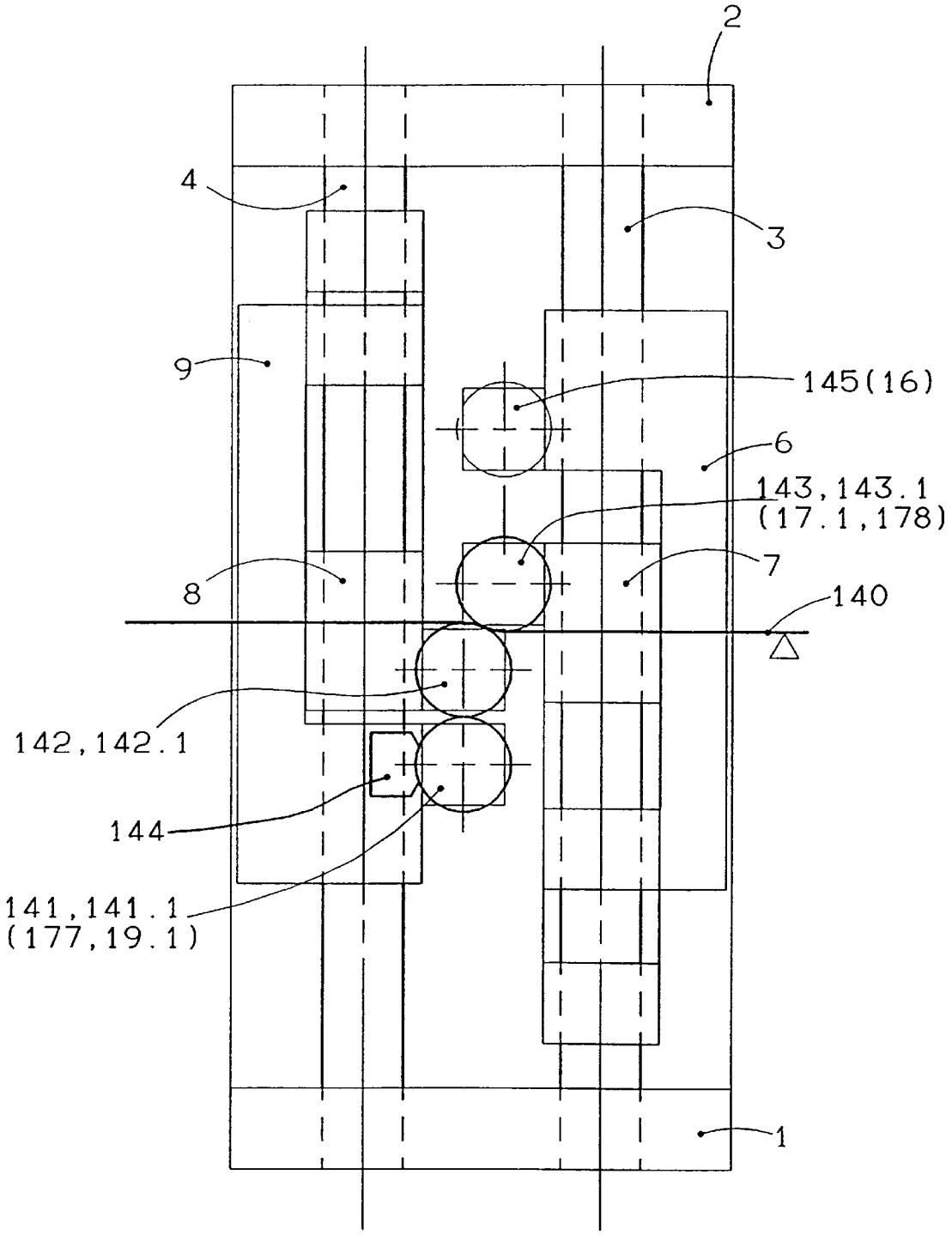
FIG. 23 is a side view of a printing unit for flexographic printing according to an embodiment of the invention.

FIG. 23 shows a printing unit which is set up for printing a web 140 on one side with the aid of the flexographic printing method. It has an engraved roller 141, a block cylinder 142 and an impression cylinder 143. The fourth printing unit cylinder 145 has been moved aside into a position of rest by means of the slide 6. It does not even need to be installed in the printing unit at all. The engraved roller 141 contains a cylinder body 141.1 with an outer surface having screen wells, the block cylinder 142 contains a cylinder body 142.1 with an outer surface capable of being covered with flexographic printing blocks, and the impression cylinder 143 contains a cylinder body 143.1 with a hard, that is to say non-elastic outer surface. In other embodiments, the cylinders 141–143 may also be equipped with cylinder bodies of another kind, onto which sleeves having surfaces for the functions mentioned can be drawn, that is to say, for example, a sleeve 177, 178 having an outer surface with screen wells or an impression surface. By means of sleeves 177, 178 of this type, for example, the double printing unit according to FIG. 1 could be converted into the printing unit shown in FIG. 23. This variation is indicated by reference numerals placed in brackets. A further design of the printing unit cylinders 141–143 and 145 is the same as that of the printing unit cylinders shown in FIG. 1. The drives shown in FIG. 1 are likewise employed for the slides 6–9. Repeated illustration and description have therefore been dispensed with.

By means of the printing unit according to FIG. 23, a web 140 led through and between the block cylinder 142 and the impression cylinder 143 can be printed on one side. The engraved roller 141, inked by the inking rail device 144 at the same time inks the block which is located on the block cylinder 142 and which transfers the printing ink onto the web 140 in conformity with the image. For print throw-off, the impression cylinder 143 and the block cylinder 142, in conjunction with the engraved roller 141, are moved away from one another by displacement of the respective slide 7–9, or a throw-off movement is imparted only to the impression cylinder 143 or to the block cylinder 142, in conjunction with the engraved roller 141.

If the web 134 is to be printed on only one side, a printing unit also will need to be assembled with only two printing unit cylinders, for example the printing unit cylinders 18 and 19 according to FIG. 22. The carrier 3 may also be dispensed with here. Printing methods other than those described may also be employed.

The printing units or double printing units described may be employed individually. Likewise, a plurality of printing units may be arranged next to one another and may print one or more webs. The use of these multiple printing units involves rolling and a folding appliance or rewinding. In all cases, the carriers 3, 4 or 71, 72 stand vertically.

Figure 24:
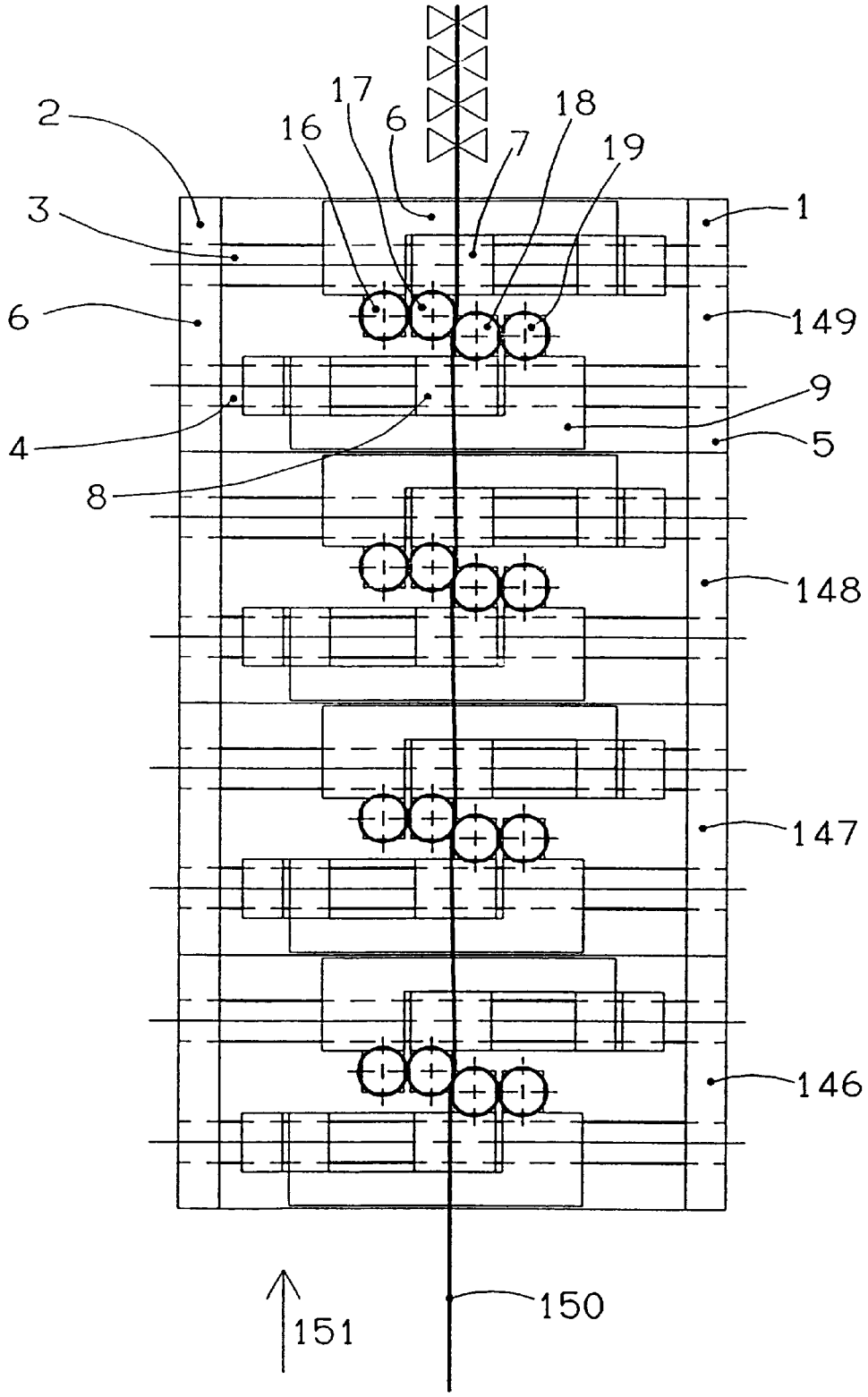
FIG. 24 is a printing unit tower formed from double printing units placed one on the other and having horizontally arranged carriers.

However, the carriers may also be arranged horizontally, as shown in FIG. 24. Four double printing units 146 to 149 are illustrated, and these are advantageously stacked one on the other on their end plates 1, 2 to form a printing unit tower. This variation is space-saving in terms of the base area required. Using the previous reference symbols, each double printing unit 146–149 contains two carriers 3, 4, on which the slides 6–9 together with the printing unit cylinders 16–19 are displaceably arranged. The further equipping of the printing units with components is carried out according to one of the embodiments described. In the exemplary embodiment, during the passage of a web 150 in direction 151, the double printing units 146–149 print this with four colors on each of the two sides by an indirect printing method.

Figure 25:
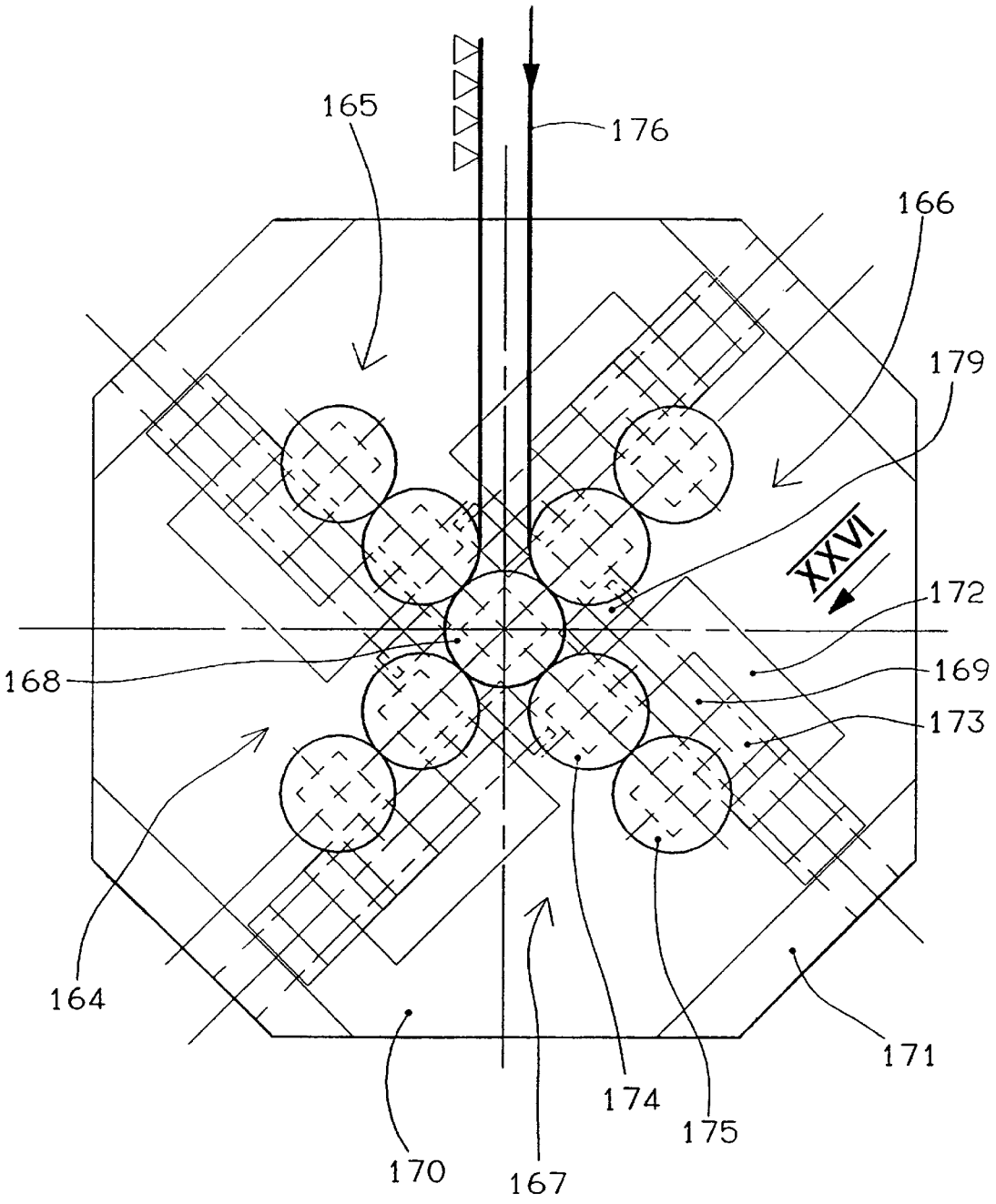
FIG. 25 is a satellite printing unit.

FIG. 25 shows a satellite printing unit, in which four printing units 164 to 167 are arranged around a satellite cylinder 168. Each printing unit 164 to 167 contains a carrier 169 which is closed off by an end plate 171 fastened to a wall 170. Advantageously, each carrier 169 is mounted at its other end by means of a support bearing 179 fastened to the wall 170. Mounted slideably on each carrier 169 are two slides 172, 173, in which a transfer cylinder 174 and a form cylinder 175 are respectively mounted. The printing unit cylinders 174, 175 are advantageously mounted, once again, by means of motor spindles which are not illustrated. Furthermore, the slides 172, 173 are identical in design to the slides 5, 6 according to FIG. 1. The drive of the slides 172, 173 and the further equipping of the printing units 164 to 167 are also carried out according to one of the embodiments already described, so that there is no need for further illustrations and explanations. The carriers 169 of the printing units 164 to 167 are arranged so as to be inclined to the horizontal such that the printing unit cylinders 174, 175 mounted on them are adjustable in the direction of the satellite cylinder 168. The satellite cylinder 168 serves as an impression cylinder for those transfer cylinders 174 of the printing units 164 to 167 which are thrown onto it. Said satellite cylinder is advantageously mounted on a motor spindle 180 fastened in the wall 170.

Figure 26:
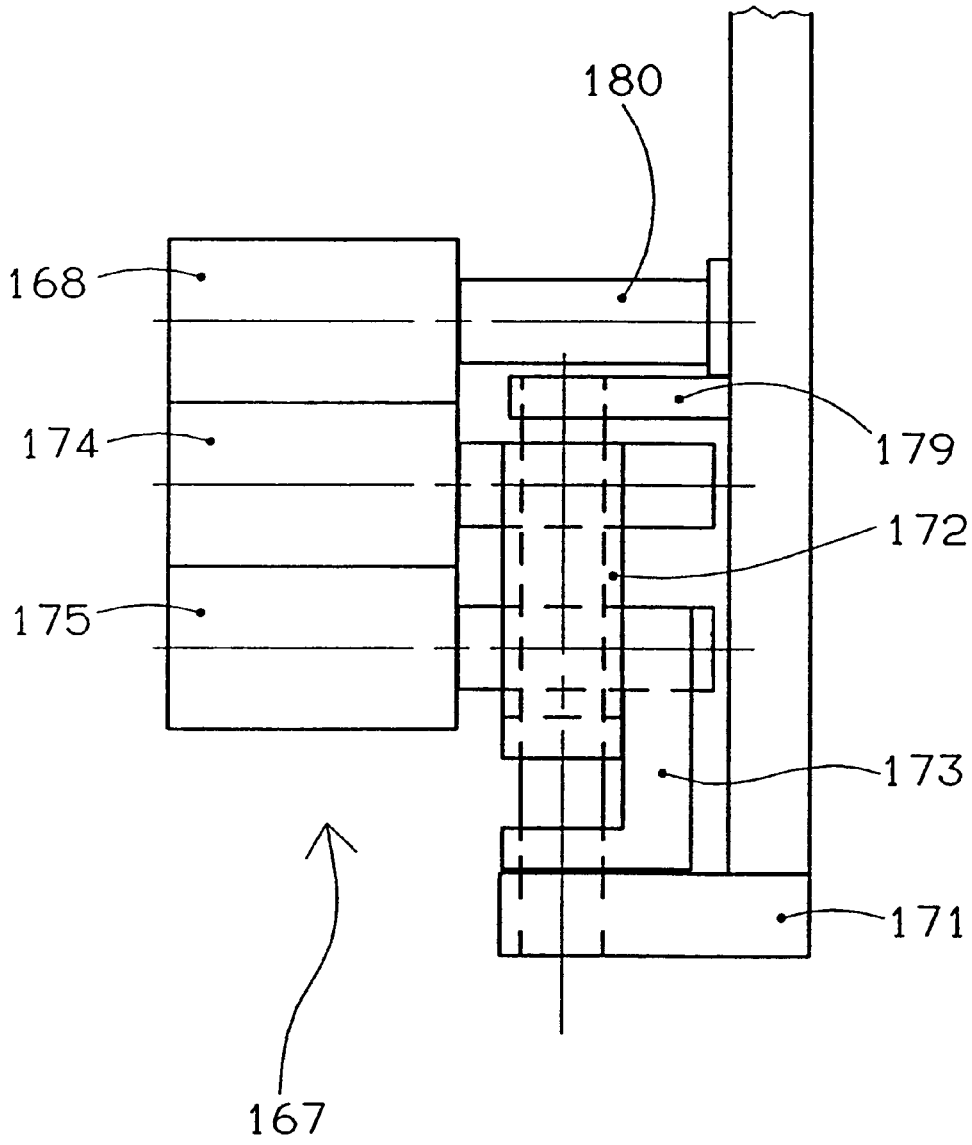
FIG. 26 is a view of the satellite printing unit of FIG. 25 taken from the perspective indicated by XXVI.

Each form cylinder 175 (the printing form of which is inked by an inking unit, not illustrated) transfers the printing image onto the adjacent transfer cylinder 174 which transfers the printing image onto the web 176 led through and between it and the satellite cylinder 168. Depending on component equipment, the satellite printing unit may operate for example, by the offset printing method or the indirect intaglio printing method. However, the satellite printing unit may also be set up for or converted to other printing variants already described, such as flexographic printing, direct intaglio printing or direct lithographic printing. In addition to the overhung mounting of the printing unit cylinders 168, 174, 175 (FIG. 26), which is shown, it is also possible for these to be mounted on both sides. Other web runs through the satellite printing unit can also be implemented.

The invention is not limited by the embodiments described above which are presented as examples only but can be modified in various ways within the scope of protection defined by the appended patent claims.

I claim:

1. A printing unit for a web-fed rotary printing machine having at least one form cylinder, and at least one impression cylinder as printing unit cylinders, and an inking device for the form cylinder, wherein a distance between two adjacent printing unit cylinders is linearly adjustably in a guided manner, each of said printing unit cylinders having an electric drive motor, the printing unit comprising:

a plurality of slides for operably receiving and mounting at least one side of each of said printing unit cylinders;

at least one carrier for supporting said plurality of slides; and drive means coupled to said plurality of slides for operably adjusting a distance between printing unit cylinders.

2. The printing unit according to claim 1, further comprising a transfer cylinder disposed between said at least one form cylinder and said at least one impression cylinder.

3. The printing unit according to claim 2, wherein said transfer cylinder cooperates with a transfer cylinder of another printing unit to additionally serve as an impression cylinder.

4. The printing unit according to claim 3, wherein one of the at least one form cylinders is displaced from operable contact with the adjacent transfer cylinder and thereby put out of operable communication with a printing web enabling printing on one side of the printing web between the transfer cylinders.

5. The printing unit according to claim 3, wherein one of said transfer cylinders can be displaced from contact with a printing web and thereby enable printing on one side of the printing web between another of said transfer cylinders and said at least one form cylinder.

6. The printing unit according to claim 1, wherein each of said printing unit cylinders are overhung from said mounted position in said slides.

7. The printing unit according to claim 1, further comprising another plurality of slides for receiving and mounting opposing sides of each of said plurality of printing unit cylinders.

8. The printing unit according to claim 1, further comprising at least one end plate fastened to at least one end of said carriers.

9. The printing unit according to claim 8, wherein each of said at least one end plate is split transversely to a longitudinal axis of the printing unit cylinders into a left and a right individual plate, and further comprising:

a plurality of crossmembers having ends fixedly connected to said left and right plates and operably enabling a distance adjustment between said left and right plates.

10. The printing unit according to claim 1, wherein said slides operably receive and mount printing unit cylinders having different diameters.

11. The printing unit according to claim 1, further comprising a motor spindle mounted in each of said plurality of slides, wherein the printing cylinders comprise a cylinder body releasably fastened to said motor spindle.

12. The printing unit according to claim 7, wherein each of said plurality of another slides further comprise a cone for receiving and mounting said opposing sides of said printing unit cylinders, said cone being axially displaceable from said cylinders to enable exchange of a cylinder body.

13. The printing unit according to claim 11, wherein said cylinder body is replaceable with a cylinder body having a different diameter.

14. The printing unit according to claim 11, wherein said cylinder body receives a sleeve, said cylinder body for receiving a sleeve being replaceable with a cylinder body having a clamping system for a plate.

15. The printing unit according to claim 1, wherein the printing unit cylinders further comprise a sleeve having a casing comprising one from a group consisting of a printing form, a transfer form, and impression surface and wells capable of being filled with ink.

16. The printing unit according to claim 15, wherein said sleeve is removable from the printing cylinder and replaceable with another sleeve.

17. The printing unit according to claim 15, wherein said sleeve can be changed in response to a desired printing method.

18. The printing unit according to claim 16, wherein said another sleeve has a different diameter that said sleeve.

19. The printing unit according to claim 12, wherein said cylinder body receives a sleeve, said sleeve being changeable through axial displacement of said cone away from the engaged end of said printing cylinder and movement of said plurality of another slides out of a changing region of the sleeve.

20. The printing unit according to claim 1, wherein the inking device is disposed on each of said plurality of slides accommodating form cylinders such that the inking device is movable toward and away from said form cylinders.

21. The printing unit according to claim 1, wherein the inking devices for different printing methods comprises an inking device module capable of being fastened to each of said plurality of slides accommodating form cylinders.

22. The printing unit according to claim 1, further comprising:

a printing form erasing device and an imaging device directly or indirectly fastened to said at least one carrier, wherein said form cylinder is movable into a region of the printing form erasing device and a region of the imaging device by the one of said plurality of slides for moving said form cylinder.

23. The printing unit according to claim 22, further comprising means for moving said printing form erasing device toward and away from the form cylinder for adaptation to variations in diameter of said cylinder.

24. The printing unit according to claim 22, further comprising means for moving said imaging device toward and away from the form cylinder for adaptation to variations in diameter of said cylinder.

25. The printing unit according to claim 1, wherein said at least one carrier is vertically arranged.

26. The printing unit according to claim 1, wherein said at least one carrier is horizontally arranged.

27. The printing unit according to claim 1, wherein the impression cylinder is designed as a fixed satellite cylinder, and a plurality of carriers are angularly arranged around said satellite cylinder such that the printing unit cylinders mounted on said carriers are adjustable in a direction of the satellite cylinder.

28. The printing unit according to claim 1, wherein said drive means is controlled in terms of displacement travel of the same.

29. The printing unit according to claim 28, wherein each of said slides further comprises a spindle nut and a threaded spindle having one end engaging said spindle nut, and an opposing end driven by said drive means, said drive means comprising a servo motor for each slide.

30. The printing unit according to claim 28, wherein said drive means comprises a hydraulic cylinder.

31. The printing unit according to claim 28, wherein said drive means comprises an electromechanical actuating unit.

* * * * *